US007011400B2

(12) United States Patent
Nakano

(10) Patent No.: US 7,011,400 B2
(45) Date of Patent: Mar. 14, 2006

(54) WIDTH DETECTION METHOD AND WIDTH DETECTION APPARATUS OF RECORD MEDIUM AND RECORD APPARATUS

(75) Inventor: Shuichi Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/383,867

(22) Filed: Mar. 10, 2003

(65) Prior Publication Data

US 2004/0114984 A1 Jun. 17, 2004

(30) Foreign Application Priority Data

Mar. 8, 2002 (JP) ..... P2002-063000

(51) Int. Cl.
*B41J 2/01* (2006.01)

(52) U.S. Cl. ..... 347/101; 347/16; 400/708

(58) Field of Classification Search ..... 347/16, 347/104–107, 101, 14, 19; 400/708
See application file for complete search history.

(56) References Cited

U.S. PATENT DOCUMENTS 5,618,120 A * 4/1997 Ishikawa ..... 347/16

* cited by examiner

*Primary Examiner*—Manish S. Shah
(74) *Attorney, Agent, or Firm*—Sughrue Mion, PLLC

(57) ABSTRACT

The values of the detection signals of a record medium and the placement face thereof detected as a recording head moves from one end of the record medium to an opposite end are stored. A predetermined threshold value is found based on a profile found from the stored values of the detection signals. Both ends of the record medium are determined according to the threshold value and the width of the record medium is found. Accordingly, the threshold value matching the used record medium can be set, so that an easy determination can be made as to whether or not change of the detection signal exceeding the threshold value occurs and change of the detection signal falling below the threshold value occurs, and the width of the record medium can be found accurately.

12 Claims, 21 Drawing Sheets

WIDTH DETECTION METHOD AND WIDTH DETECTION APPARATUS OF RECORD MEDIUM AND RECORD APPARATUS

BACKGROUND OF THE INVENTION

This invention relates to a width detection method and a width detection apparatus for detecting the width of a record medium on which information is recorded by a recording head, and a record apparatus including the width detection apparatus.

Generally, a large printer, one of record apparatus in related arts, includes a paper feed section for supplying record roll paper, for example, as a record medium, a record section for recording information on supplied roll paper, and a paper ejection section for ejecting the roll paper with information recorded, disposed in this order from top to bottom. To use such a large printer, for example, an ink jet printer, the user stores roll paper in the paper feed section and draws out the leading edge of the roll paper. The user passes the leading edge of the roll paper through the top of a flat paper feed guide serving as a paper transport face and sandwiches the leading edge between a paper feed roller and a driven roller and starts the ink jet printer.

Then, the ink jet printer rotates the paper feed roller for delivering the roll paper onto a flat platen serving as a paper transport guide face and ejects ink droplets from nozzle openings of a recording head for recording information on the roll paper while moving a carriage on which the recording head is mounted in the width direction of the roll paper. The ink jet printer rotates a paper ejection roller for ejecting the roll paper to a paper receptacle through the top of a flat paper ejection guide serving as a paper transport face.

A paper width detection apparatus is disposed in such a large ink jet printer because the flexibility of the width of available roll paper is wide. The paper width detection apparatus detects the width of roll paper by detecting paper while moving a paper detection sensor mounted on a carriage in the width direction of the roll paper. FIG. 23 is a block diagram to show a paper width detection apparatus 1 in a related art. This paper width detection apparatus 1 includes an encoder 2, a photointerrupter 3, a paper detection sensor 4, head position determination means 5, an A/D converter 6, a CPU 7, and memory 8.

The encoder 2 is disposed in the printer main unit and the photointerrupter 3 is disposed on a carriage 9 for generating a pulse signal PLS when the photointerrupter 3 crosses a slit of the encoder 2. The paper detection sensor 4 applies light, for example, detects the reflected light amounts on the roll paper surface and the platen surface (reflected light amount on the roll paper surface>reflected light amount on the platen surface) and the contrast between the edge of the roll paper and the platen surface, and generates a detection signal PDA. The head position determination means 5 determines the position of the recording head based on the pulse signal PLS from the photointerrupter 3 and generates a head position signal HPS.

The A/D converter 6 converts the analog detection signal PDA from the paper detection sensor 4 into a digital detection signal PDD. The CPU 7 stores the head position signal HPS from the head position determination means 5 in the memory 8 based on the detection signal PDD from the A/D converter 6, and computes the roll paper width based on the head position signal HPS.

The roll paper width detection operation in the configuration will be discussed with reference to the block diagram of FIG. 23, a time chart of FIG. 24, and a flowchart of FIG. 25. The head position determination means 5 determines the position of the recording head based on a pulse signal PLS of a 1/180 inch period sent from the photointerrupter 3 and generates a head position signal HPS. The CPU 7 reads the head position signal HPS from the head position determination means 5 in a shorter period than the pulse interval (step S1). When determining that the head position signal HPS changes (step S2), the CPU 7 sends a conversion start command CSS of an analog detection signal PDA to the A/D converter 6.

Upon reception of the conversion start command CSS of an analog detection signal PDA from the CPU 7, the A/D converter 6 starts processing of converting the analog detection signal PDA sent from the paper detection sensor 4 into a digital detection signal PDD. Upon completion of converting the analog signal into the digital detection signal PDD, the A/D converter 6 generates a conversion end interrupt signal CES and sends the signal CES to the CPU 7.

The CPU 7 reads the detection signal PDD from the A/D converter 6 (step S3) with the conversion end interrupt signal CES from the A/D converter 6 received at the pulse interval as a trigger, and determines whether or not change of the detection signal PDD exceeding a predetermined threshold value occurs (step S4). When determining that change of the detection signal PDD exceeding the predetermined threshold value occurs, the CPU 7 stores the head position signal HPS in the memory 8 (step S5). The CPU 7 reads the head position signals HPS when the detection signal PDD exceeds the predetermined threshold value and the detection signal PDD falls below the predetermined threshold value, namely, the head position signals HPS of both end parts of the roll paper from the memory 8, and computes the roll paper width (patent document 1: JP-A-2002-103721).

A business-grade ink jet printer handles various paper types and can handle thin paper, etc., that cannot be picked up by a paper feed mechanism of a consumer ink jet printer (auto sheet feeder (ASF)). In roll paper not transported in an intimate contact state with a platen like thin paper, moderate output change is produced as the paper detection sensor 4 of the paper width detection apparatus in the related art described above crosses the boundary between the edge of roll paper and the platen surface, and it is difficult to accurately find the roll paper width by the method of determining whether or not change of exceeding the predetermined threshold value and change of falling below the predetermined threshold value occur as described above.

SUMMARY OF THE INVENTION

It is therefore an object of the invention to provide a width detection method and a width detection apparatus of a record medium capable of detecting the width of any of various record media and a record apparatus including the width detection apparatus.

To the end, according to one aspect of the invention, there is provided a width detection method of a record medium for detecting the width of the record medium on which information is recorded by a recording head, the width detection method including the steps of storing the values of the detection signals of the record medium and the placement face thereof detected as the recording head moves from one end of the record medium to an opposite end; finding a predetermined threshold value based on a profile found from the values of the detection signals; and determining both ends of the record medium according to the threshold value and finding the width of the record medium. The threshold value may be found based on a profile of the values of all detection signals stored at the pulse interval input as the recording head moves from the one end of the record medium to the opposite end. The threshold value may be calculated based on the difference between the value of the detection signal of the record medium and the value of the detection signal of the placement face of the record medium. After the change rate of the value of the detection signal in the transition area between the end of the record medium and the placement face of the record medium is determined and what type the record medium is is determined, the threshold value may be calculated based on the difference between the value of the detection signal of the record medium and the value of the detection signal of the placement face of the record medium. Accordingly, the threshold value matching the used record medium can be set, so that an easy determination can be made as to whether or not change of the detection signal exceeding the threshold value occurs and change of the detection signal falling below the threshold value occurs, and the width of the record medium can be found accurately.

To the end, according to another aspect of the invention, there is provided a width detection apparatus of a record medium for detecting the width of the record medium on which information is recorded by a recording head, the width detection apparatus including medium detection means for sending the detection signals of the record medium and the placement face thereof detected as the recording head moves from one end of the record medium to an opposite end; transfer means for writing the detection signals from the medium detection means into storage means; computation processing means for finding a predetermined threshold value based on a profile found from the values of the detection signals stored in the storage means, determining both ends of the record medium according to the threshold value, and finding the width of the record medium. The width detection apparatus may further include head detection means for sending a pulse signal as the recording head moves, wherein the medium detection means may send the detection signals of the record medium and the placement face thereof at the pulse interval of the pulse signal from the head detection means and the computation processing means may find the predetermined threshold value based on a profile of the values of all detection signals stored in the storage means. The computation processing means may find the threshold value based on the difference between the value of the detection signal of the record medium and the value of the detection signal of the placement face of the record medium. The computation processing means may determine the change rate of the value of the detection signal in the transition area between the end of the record medium and the placement face of the record medium and determine what type the record medium is and then find the threshold value based on the difference between the value of the detection signal of the record medium and the value of the detection signal of the placement face of the record medium. Accordingly, the threshold value matching the used record medium can be set, so that an easy determination can be made as to whether or not change of the detection signal exceeding the threshold value occurs and change of the detection signal falling below the threshold value occurs, and the width of the record medium can be found accurately. In the related art, the CPU acquires the head position signal, determines position change of the recording head, sends a conversion start command of a detection signal, and acquires and stores detection signals. In the invention, however, the transfer means reads and writes the detection signals, so that each process can be completed in a short time and the record medium width detection time can be shortened drastically.

The transfer means may be a DMAC. The computation processing means may be a CPU. Accordingly, hardware processing rather than software processing can be performed as the processing, so that the read and write processing time of the detection signal can be shortened drastically.

To the end, according to another aspect of the invention, there is provided a record apparatus for recording information on a record medium by scanning a recording head, the record apparatus including a width detection apparatus of a record medium. Accordingly, a record apparatus for providing the described advantages can be provided.

DETAILED DESCRIPTION OF THE PREFERRED EMBODIMENTS

Referring now to the accompanying drawings, there are shown preferred embodiments of the invention.

Figure 1:
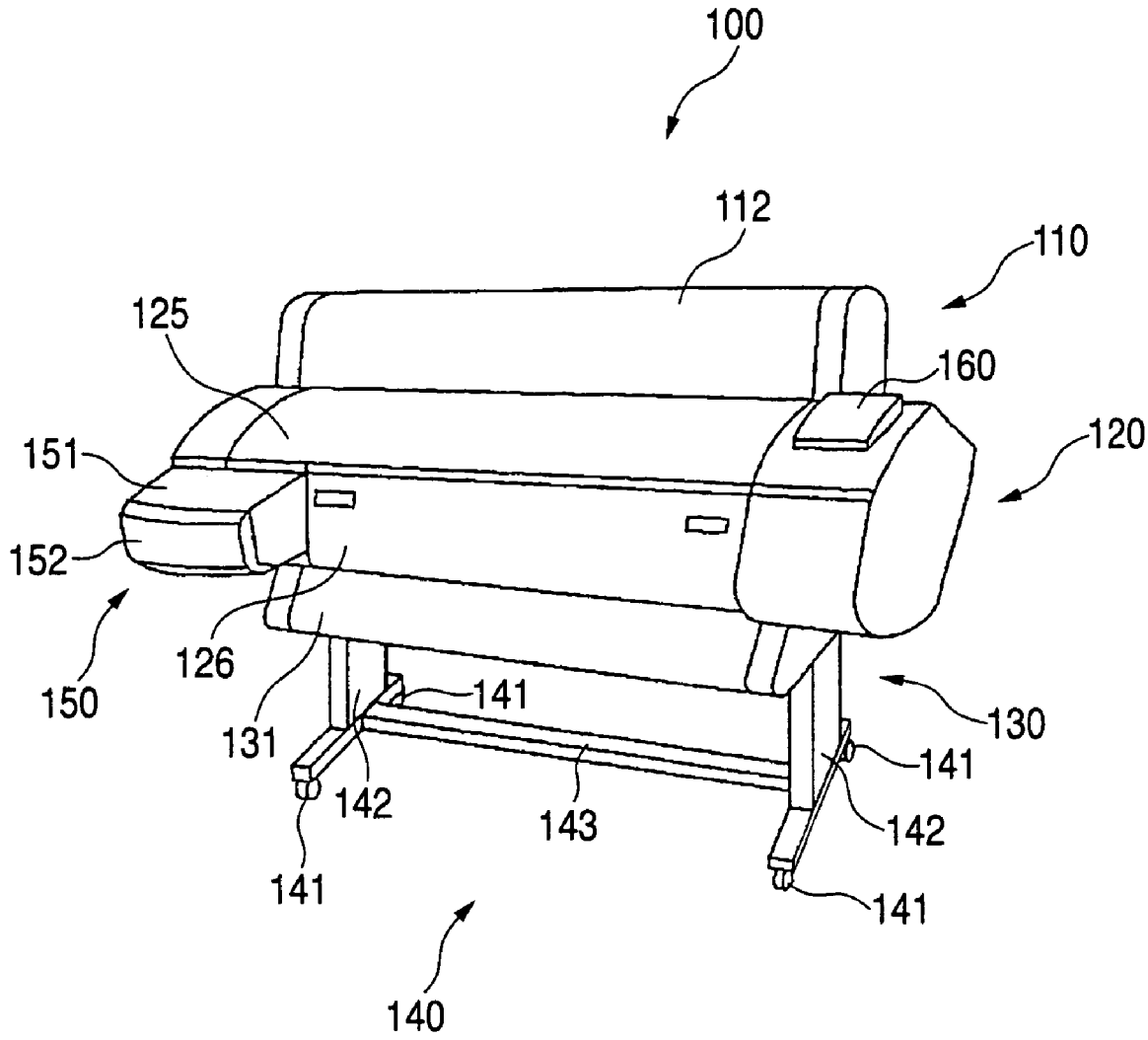
FIG. 1 is a perspective view to show a structure example of an ink jet printer, one of record apparatus according to an embodiment of the invention.
Figure 2:
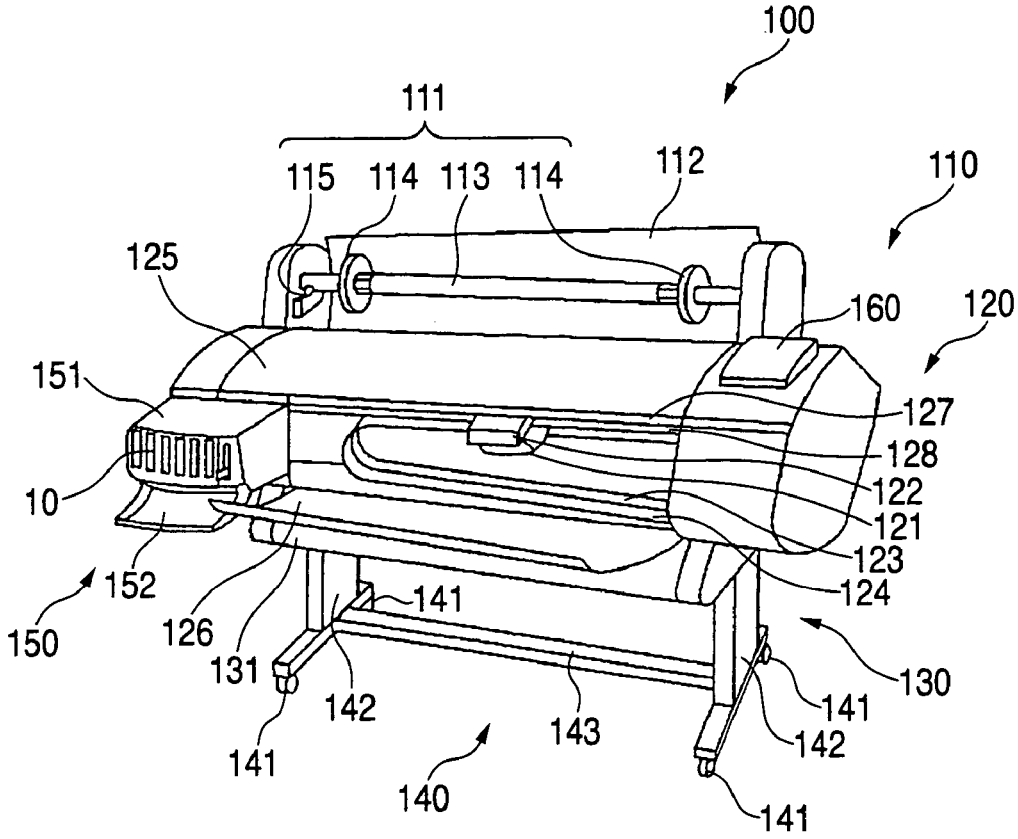
FIG. 2 is a perspective view to show an internal structure example of the main part of the printer.

FIG. 1 is a perspective view to show a structure example of an ink jet printer, one of record apparatus according to an embodiment of the invention. FIG. 2 is a perspective view to show an internal structure example of the main part of the ink jet printer. The ink jet printer 100 shown in FIGS. 1 and 2 is a large printer that can record up to record paper of comparatively large sizes such as A1 size of the JIS standard and B1 size of the JIS standard, for example, and has a paper feed section 110, a record section 120, a paper ejection section 130, and a leg section 140 disposed in this order from top to bottom. The record section 120 and the paper ejection section 130 are integral as the main unit and can be separated from the paper feed section 110 and the leg section 140.

The paper feed section 110 is placed so as to project to the upper rear of the main unit 120, 130, as shown in FIG. 1. The paper feed section 110 contains a roll paper holder 111 on which one roll of record paper, which will be hereinafter referred to as roll paper, as shown in FIG. 2. A flip-up roll paper cover 112 that can be opened and closed is attached to the front of the paper feed section 110 so as to cover the roll paper holder 111, as shown in FIGS. 1 and 2.

The roll paper holder 111 includes a spindle 113 and a pair of flange-shaped roll paper pressers 114 to hold roll paper and a pair of spindle supports 115 attached to the inner faces of both side walls of the paper feed section 110 for enabling the spindle 113 to be attached and detached and suspended, as shown in FIG. 2. The spindle 113 is placed at both ends on the spindle supports 115 and is journaled rotatably in a state in which it is clamped by the roll paper pressers 114 with roll paper inserted in the spindle 113 at the center thereof. As shown in FIGS. 1 and 2, the whole of the roll paper cover 112 is supported for rotation and as the user lifts up the roll paper cover 112 holding the lower part or presses down the roll paper cover 112, the roll paper cover 112 is opened or closed.

The record section 120 includes a carriage 122 on which a recording head unit 121 is mounted, a flexible flat cable (FFC) 123 for electrically connecting the recording head unit 121 and a control section for executing record (not shown), ink tubes 124 for connecting the recording head unit 121 and ink cartridges 10 storing ink, a paper feed roller for transporting roll paper in a subscanning direction (not shown), paper suction means for preventing roll paper from floating up (not shown), and the like, as shown in FIG. 2. An upper lid 125 and a front lid 126 are attached to the top face and the front face of the record section 120 so as to cover the recording head unit 121, the carriage 122, etc., as shown in FIGS. 1 and 2.

The recording head unit 121 includes a black ink recording head for ejecting black ink and a plurality of color ink recording heads for ejecting color inks of light yellow, yellow, light cyan, cyan, light magenta, magenta, etc. The recording head unit 121 is provided with pressure generation chambers and nozzle openings leading thereto; as ink is stored in the pressure generation chambers and is pressurized at predetermined pressure, ink droplets of controlled sizes are ejected through the nozzle openings to roll paper.

As shown in FIG. 2, the carriage 122 is suspended from a rail 127 placed in a main scanning direction through a roller and is joined to a carriage belt 128 and as the carriage belt 128 is operated by a carriage drive (not shown), the carriage 122 is guided by the rail 127 and is reciprocated with the motion of the carriage belt 128.

The FFC 123 is connected at one end to a connector of the control section and at an opposite end to a connector of the recording head unit 121 for sending a record signal from the control section to the recording head unit 121. The ink tubes 124 are disposed for the above-mentioned color inks; each ink tube 124 is connected at one end to the corresponding color ink cartridge 10 through ink pressure supply means (not shown) and at an opposite end to the corresponding color recording head of the recording head unit 121 for sending the corresponding color ink pressurized by the ink pressure supply means from the corresponding ink cartridge 10 to the corresponding color recording head of the recording head unit 121.

As shown in FIGS. 1 and 2, the front lid 126 is supported at the lower part for rotation and as the user presses down or up the front lid 126 holding the upper part thereof, the front lid 126 is opened or closed. As the user opens the front lid 126, the record section 120 can be opened largely, so that the user can easily conduct maintenance work of the recording head unit 121, the carriage 122, etc.

The paper ejection section 130 includes a paper ejection guide 131 forming a part of a passage for transporting roll paper in the subscanning direction and a paper ejection roller for transporting roll paper in the subscanning direction (not shown), as shown in FIGS. 1 and 2. The paper ejection guide 131 is formed as a flat slope projected to the front side and enables roll paper transported from upward to be smoothly guided downward.

The leg section 140 includes two support pillars 142 having rollers 141 for moving and a reinforcement rod 143 placed on the support pillars 142, as shown in FIGS. 1 and 2. The paper feed section 110 and the main unit 120, 130 are placed on the tops of the support pillars 142 and are screwed. As the support pillars 142 are provided with the rollers 141 for moving, the paper feed section 110 and the main unit 120, 130 heavy in weight can be smoothly moved to any desired location for installation. An ejected paper reception unit for receiving roll paper ejected from the paper ejection section 130 can be installed between the support pillars 142 of the leg section 140.

Further, as shown in FIGS. 1 and 2, an ink cartridge holder 150 having a holder main unit 151 for storing and holding the color ink cartridges 10 and a cover 152 for covering the front of the holder main unit 151 is disposed on the left viewed from the front side of the main unit 120, 130. The ink cartridge holder 150 is supported with the lower part of the cover 152 rotatable relative to the holder main unit 151 and as the user presses down or up the cover 152 holding the upper part thereof, the cover 152 (ink cartridge holder 150) is opened or closed.

As shown in FIGS. 1 and 2, an operation panel 160 for the user to operate record control, etc., is disposed in an upper right portion viewed from the front side of the main unit 120, 130. The operation panel 160 is provided with a liquid crystal screen and various buttons and the user can operate the buttons while seeing the liquid crystal screen.

Figure 3:
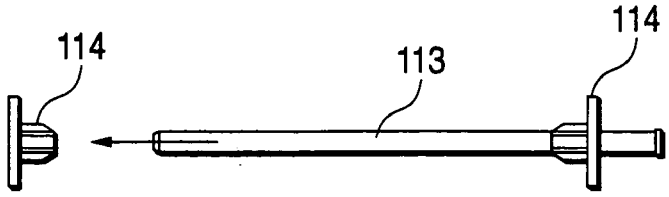
FIG. 3 is a first drawing to show a use procedure of the printer in FIG. 1.

To use the described ink jet printer 100, first the user takes out the spindle 100 forming a part of the roll paper holder 111 from the paper feed section 100 and as shown in FIG. 3, draws out one roll paper presser 114 inserted into the spindle 113 from one end of the spindle 113.

Figure 4:
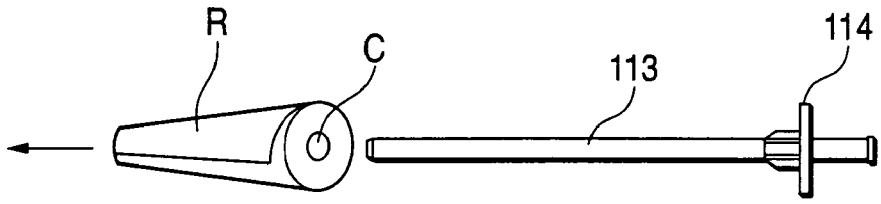
FIG. 4 is a second drawing to show the use procedure of the printer in FIG. 1.
Figure 5:
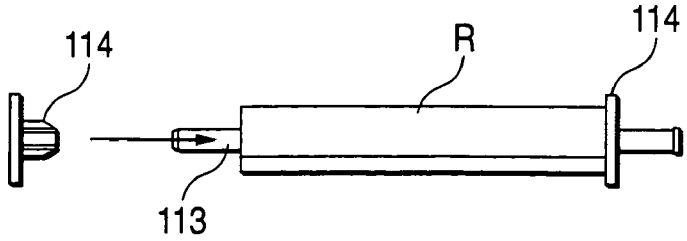
FIG. 5 is a third drawing to show the use procedure of the printer in FIG. 1.

As shown in FIG. 4, the user inserts the one end of the spindle 113 into one end of a shaft hole C of roll paper R and passes the spindle 113 through the shaft hole C and as shown in FIG. 5, fits the one end of the shaft hole C of the roll paper R into the other roll paper presser 114 inserted and fixed in the opposite end of the spindle 113. Subsequently, the user inserts the one roll paper presser 114 into one end of the spindle 113 and fits the roll paper presser 114 into the opposite end of the shaft hole C of the roll paper R. Now, it is made possible to rotate the roll paper R together with the spindle 113.

Figure 6:
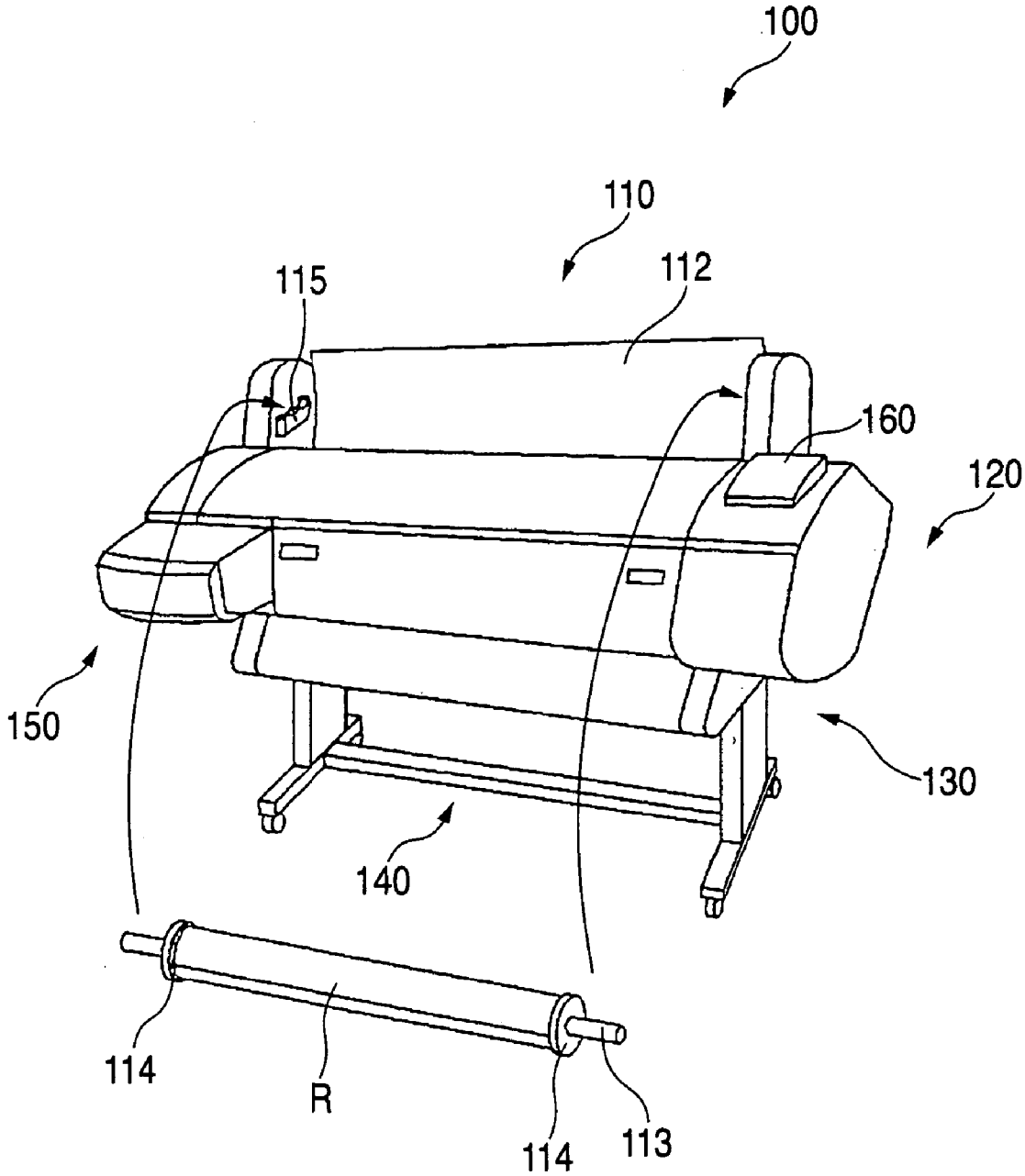
FIG. 6 is a fourth drawing to show the use procedure of the printer in FIG. 1.
Figure 7:
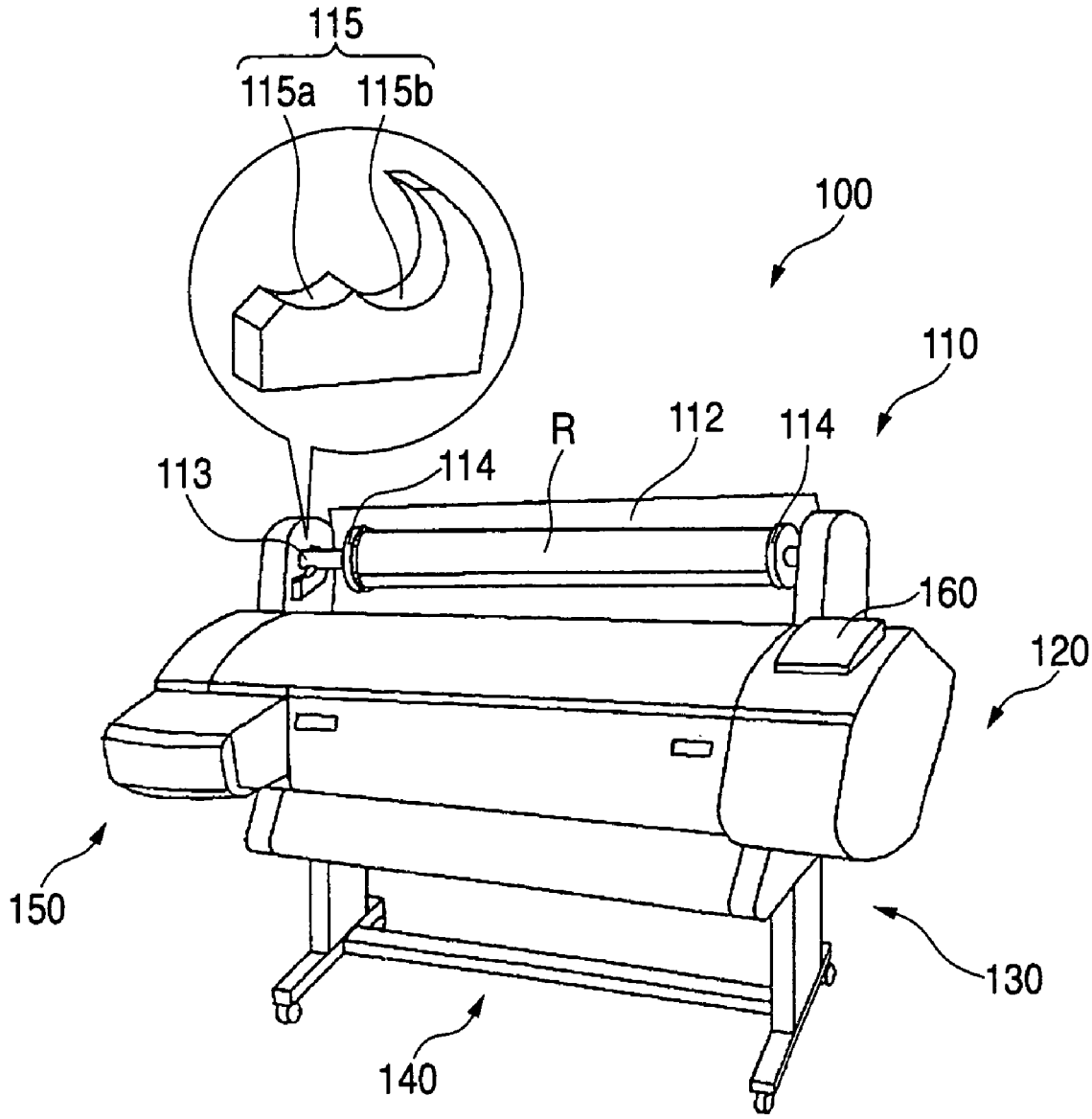
FIG. 7 is a fifth drawing to show the use procedure of the printer in FIG. 1.

Next, as shown in FIG. 6, the user holds both ends of the spindle 113 inserted in the roll paper R and lifts up the spindle 113 with the roll paper R to the paper feed section 110. Here, as shown in FIG. 7, each spindle support 115 is formed with a comparatively shallow recess 115*a* for temporarily placing the end of the spindle 113 and a comparatively deep recess 115*b* for journaling the end of the spindle 113 for rotation, the recesses 115*a* and 115*b* being placed back and forth. The front recess 115*a* is provided for temporarily placing the spindle 113 because work of fitting the spindle 113 inserted in the roll paper R heavy in weight into the regular recess 115*b* at a time involves difficulty.

Figure 8:
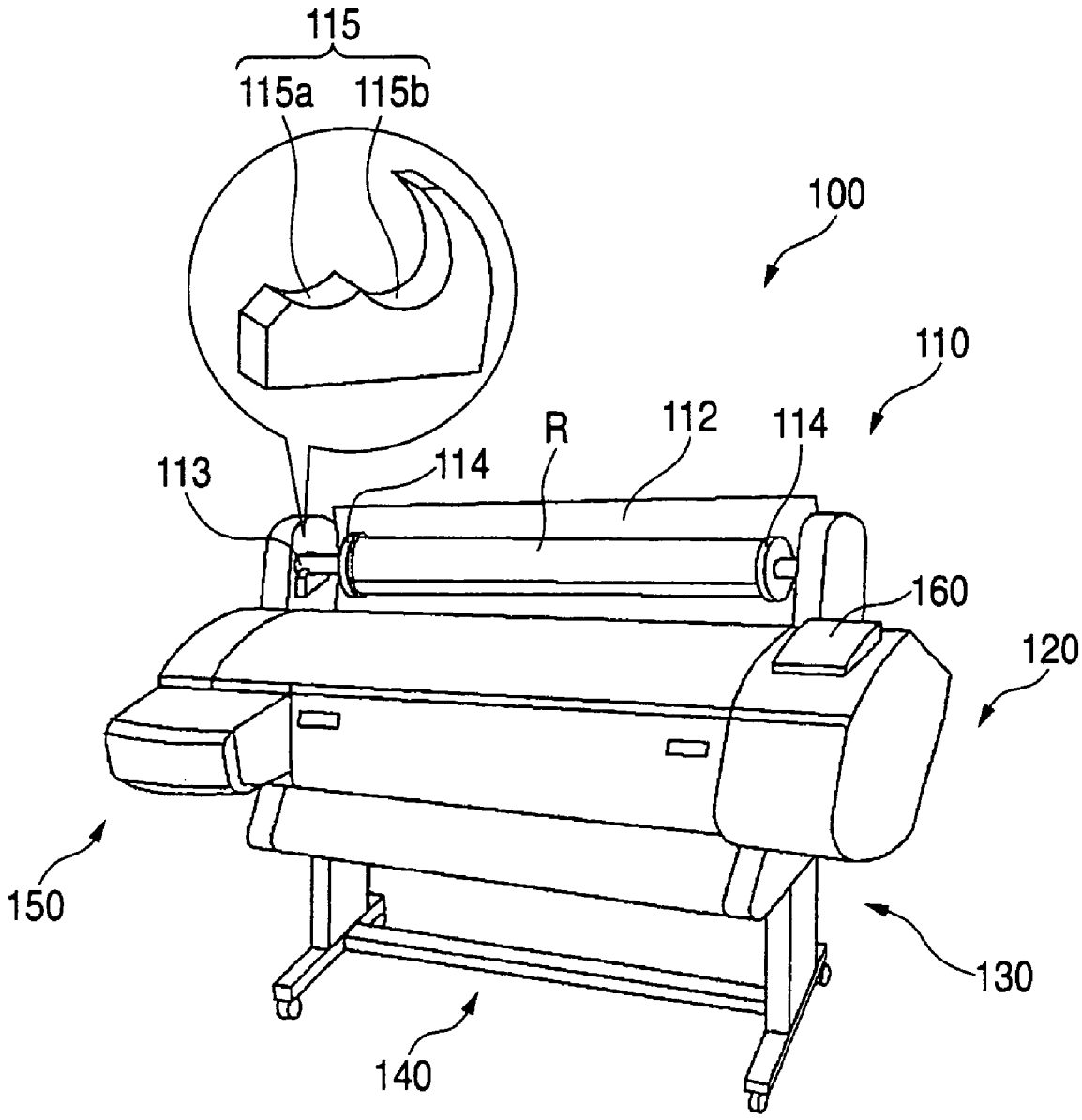
FIG. 8 is a sixth drawing to show the use procedure of the printer in FIG. 1.

Then, as shown in FIG. 7, the user once places both ends of the spindle 113 inserted in the roll paper R in the temporary placement recesses 115*a* of the spindle supports 115 and then as shown in FIG. 8, first the user hooks one end of the spindle 113 inserted in the roll paper R in the regular recess 115*b* of the corresponding spindle support 115 and next hooks the opposite end of the spindle 113 inserted in the roll paper R in the regular recess 115*b* of the corresponding spindle support 115. Accordingly, the spindle 113 inserted in the roll paper R can be set in the paper feed section 110 safely and easily.

Figure 9:
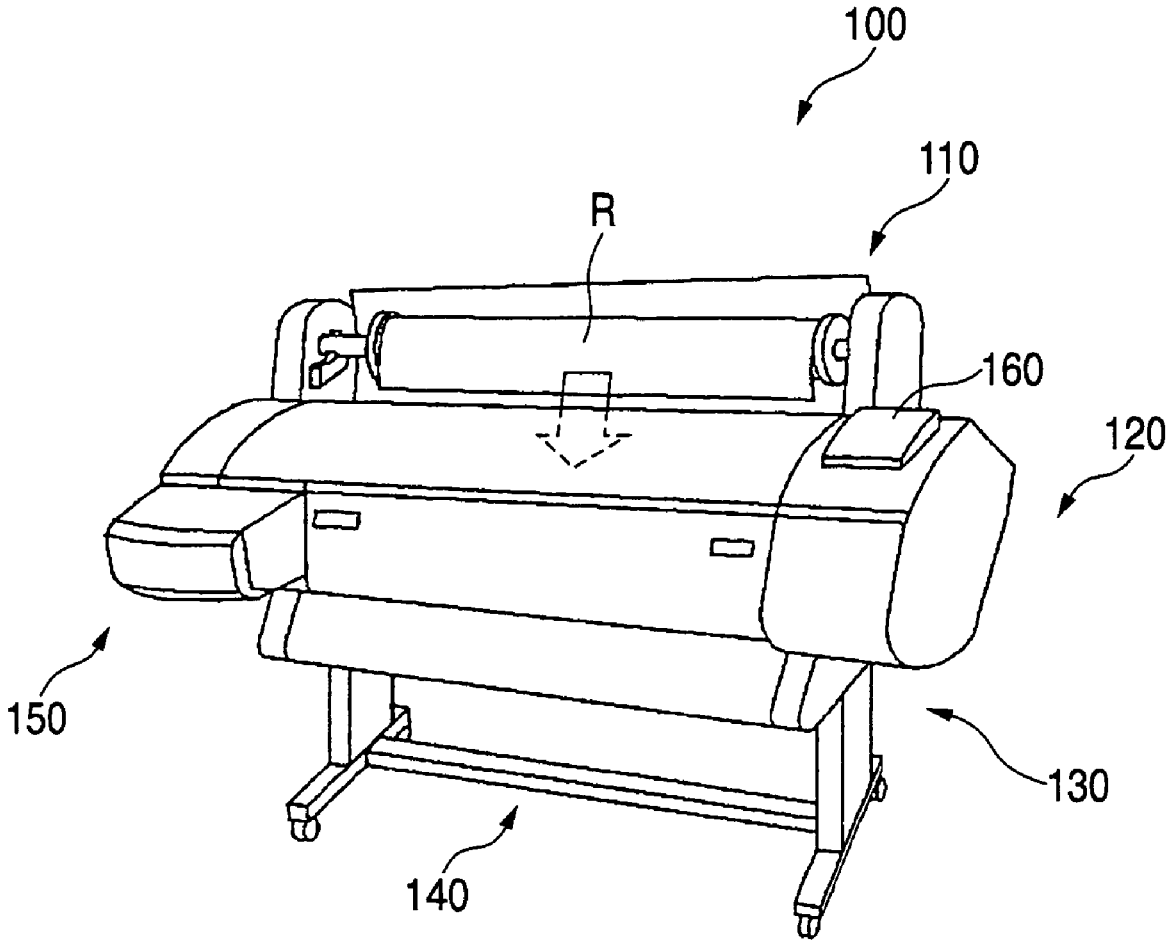
FIG. 9 is a seventh drawing to show the use procedure of the printer in FIG. 1.
Figure 10:
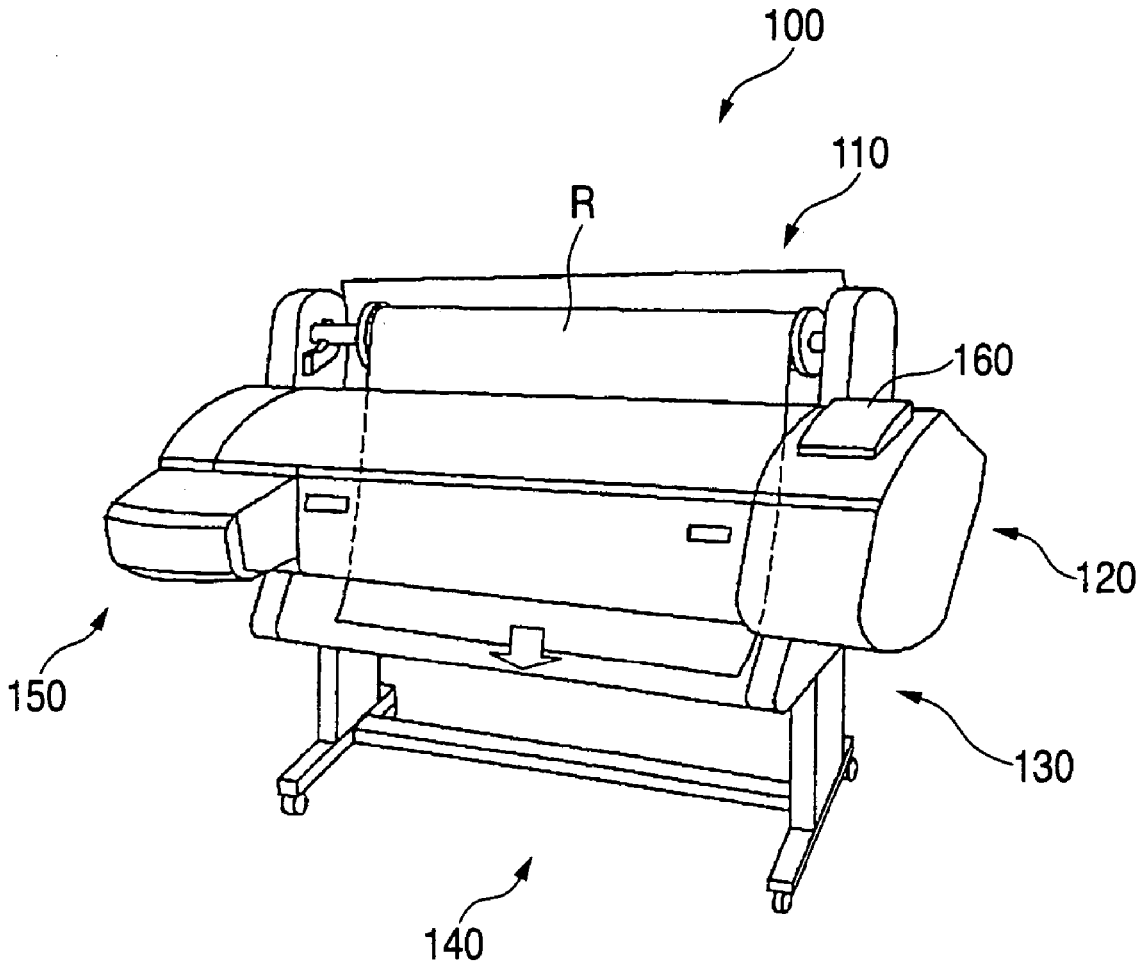
FIG. 10 is an eighth drawing to show the use procedure of the printer in FIG. 1.
Figure 11:
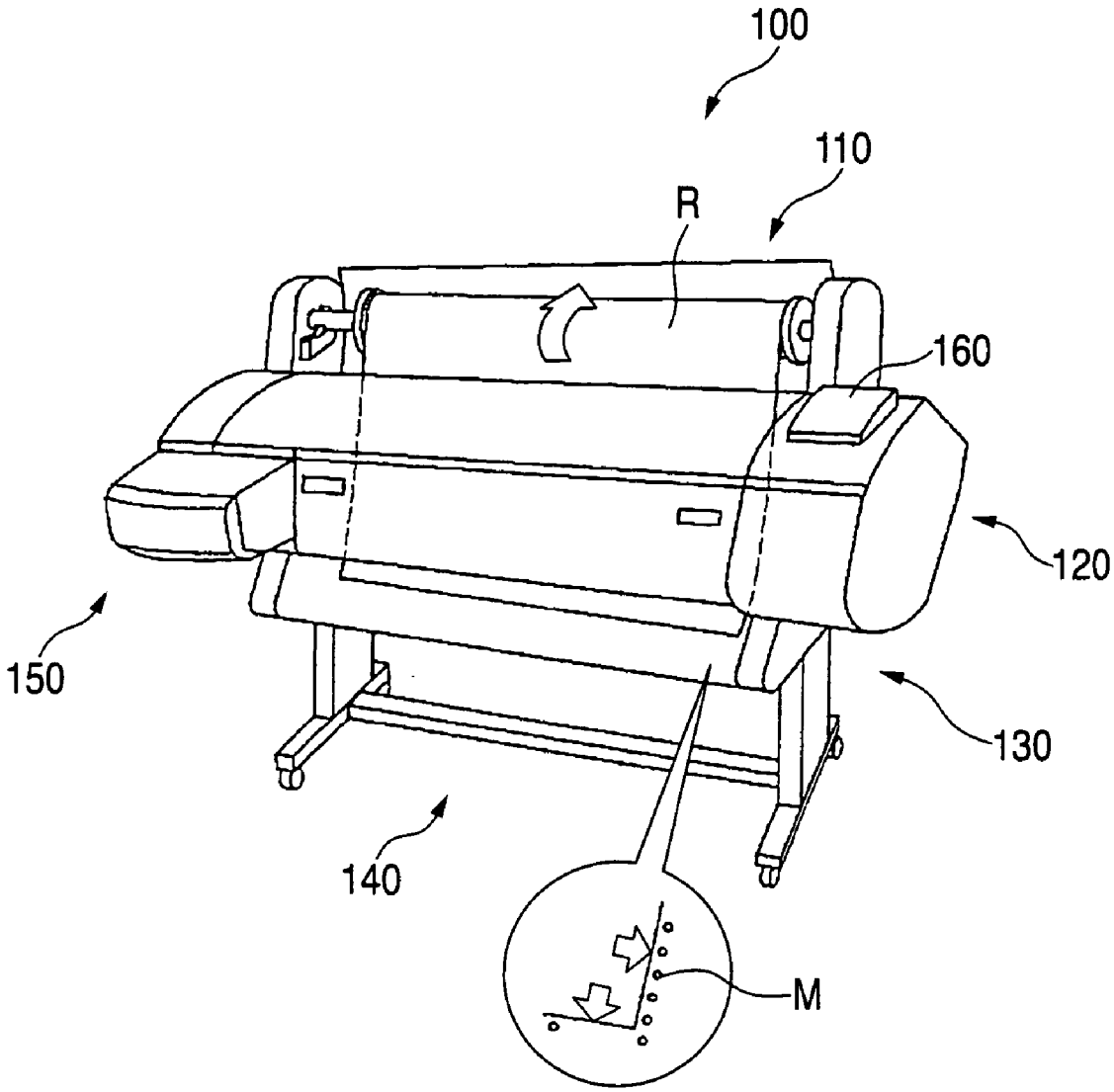
FIG. 11 is a ninth drawing to show the use procedure of the printer in FIG. 1.

Next, as shown in FIG. 9, the user draws out the leading edge of the roll paper R downward and passes the leading edge through the transport passage in the record section 120 and further as shown in FIG. 10, passes the leading edge up to the transport passage in the paper ejection section 130. As shown in FIG. 11, the user rotates the roll paper R in the winding direction for positioning the leading edge of the roll paper R at a marker M formed on the paper ejection guide 131, for example. Then, the user starts the ink jet printer 100 for feeding the roll paper R in the subscanning direction, moving the recording head unit 121 in the main scanning direction, and ejecting ink droplets for recording predetermined information on the roll paper R and then ejecting the roll paper R.

Figure 12:
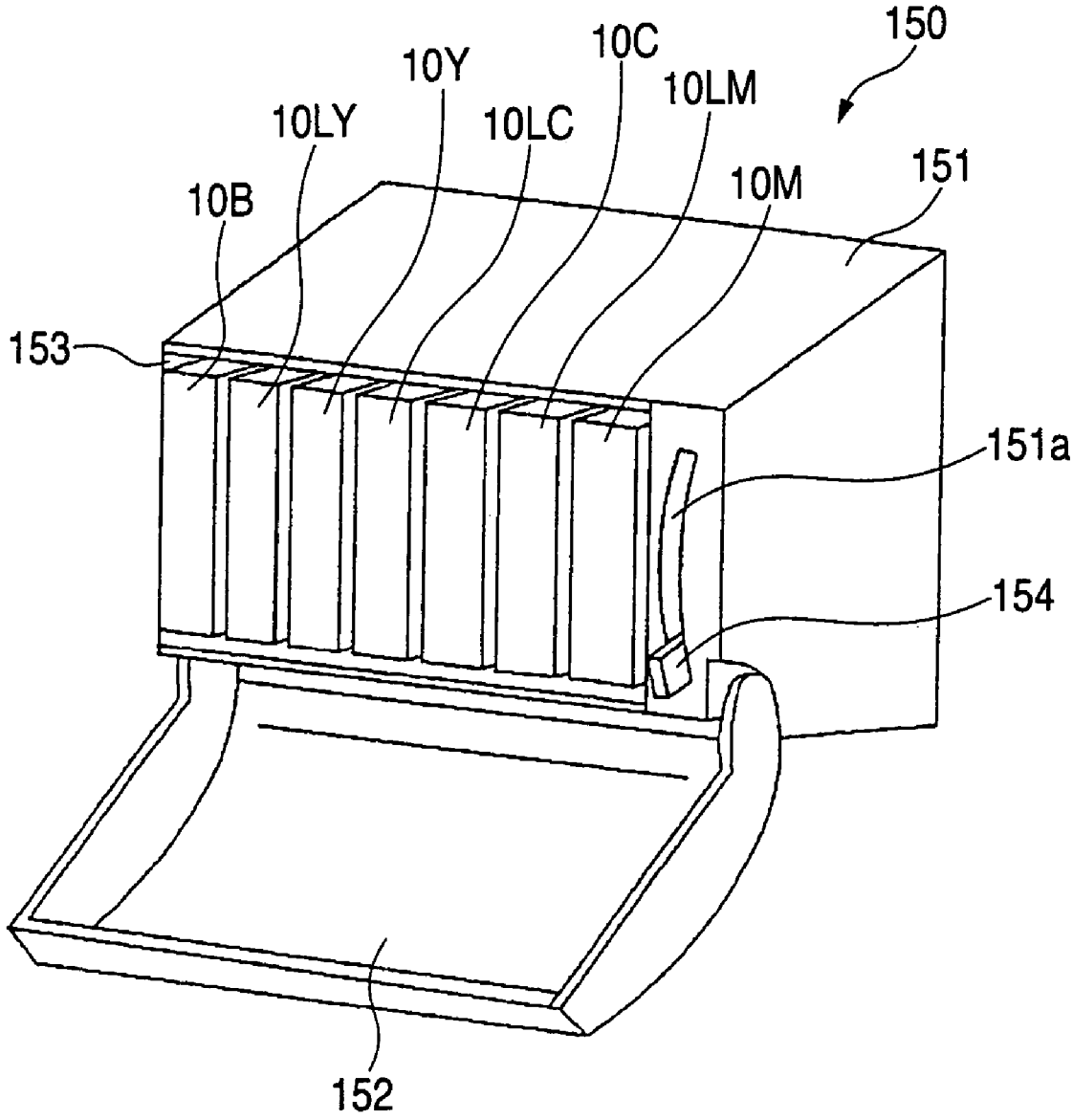
FIG. 12 is a perspective view to show details of an ink cartridge holder of the printer in FIG. 1.

FIG. 12 is a perspective view to show details of the ink cartridge holder 150. The ink cartridge holder 150 includes the holder main unit 151 attached to the front left of the main unit 120 of the ink jet printer 100 and the cover 152 attached to the front of the holder main unit 151. The holder main unit 151 contains storage sections 153 for storing the ink cartridges 10 and a control lever 154 that can be moved in an up and down direction, the storage sections 153 and the control lever 154 being placed side by side. The cover 152 has a lower part supported at the lower part of the holder main unit 151 for rotation; as the cover 152 turns downward, the front of the holder main unit 151 is opened and as the cover 152 turns upward, the front of the holder main unit 151 is closed.

The storage sections 153 placed in the holder main unit 151 are separated from each other so that a total of seven color ink cartridges 10B, 10LY, 10Y, 10LC, 10C, 10LM, and 10M of black, light yellow, yellow, light cyan, cyan, light magenta, and magenta in order from left to right in FIG. 12 can be drawn out and pushed in separately.

Figure 13:
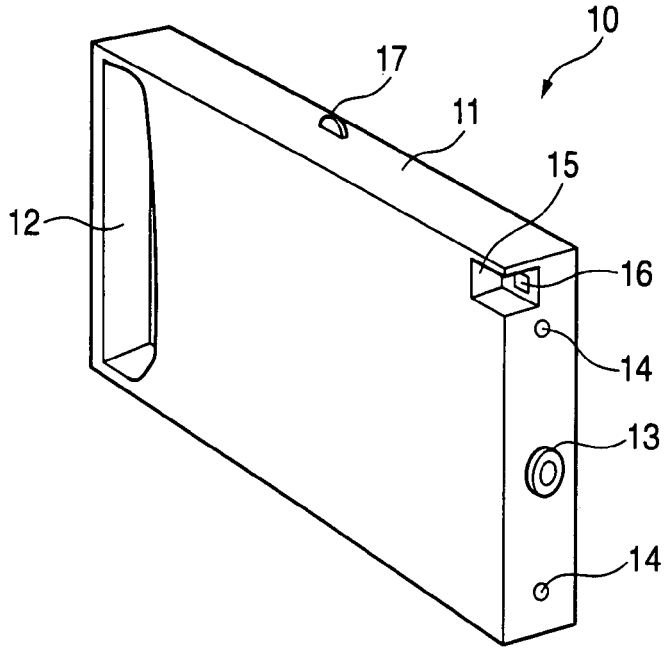
FIG. 13 is a perspective view of an ink cartridge placed in the ink cartridge holder in FIG. 12 from the rear of the ink cartridge.

FIG. 13 is a perspective view of one ink cartridge 10 from the rear thereof. The ink cartridge 10 has an ink tank formed of a flexible material, for example, like a bag and filled with ink, the ink tank being hermetically sealed in an armored case 11 formed of a hard plastic material, for example, like a rectangular parallelepiped. The armored case 11 is formed on the front of one side with a concave hold part 12 held by the user to draw out or push the ink cartridge 10 from or into the storage section 153.

For example, only six color ink cartridges are stored in a holder main unit of an ink cartridge holder in a related art and there is comparatively room and therefore to draw out or push the ink cartridge from or into the storage section, the user can insert his or her hand in the holder main unit. In the embodiment, however, the storage sections 153 for storing the seven color ink cartridges 10 and the control lever 154 need to be placed side by side in the holder main unit 151 of the ink cartridge holder 150 of the same size as that in the related art and therefore there is no room. Then, the ink cartridge 10 is formed with the concave hold part 12, whereby the user can easily draw out or push the ink cartridge 10 from or into the storage section 153.

The armored case 11 is formed at the rear center with an ink supply port 13 connected to the internal ink tank and covered with rubber packing and is formed with positioning holes 14 above and below the ink supply port 13 for positioning when the ink cartridge 10 is pushed into the storage section 153. Further, the armored case 11 is formed at a rear upper part with a recess 15 in which an IC 16 where ink information of the ink cartridge 10, for example, the manufacturing number, the ink color, remaining amount, etc., is read and written is put. Further, the armored case 11 is formed at the top center with a retention protrusion 17 for retaining the ink cartridge 10 when the ink cartridge 10 is stored in the storage section 153.

Figure 14:
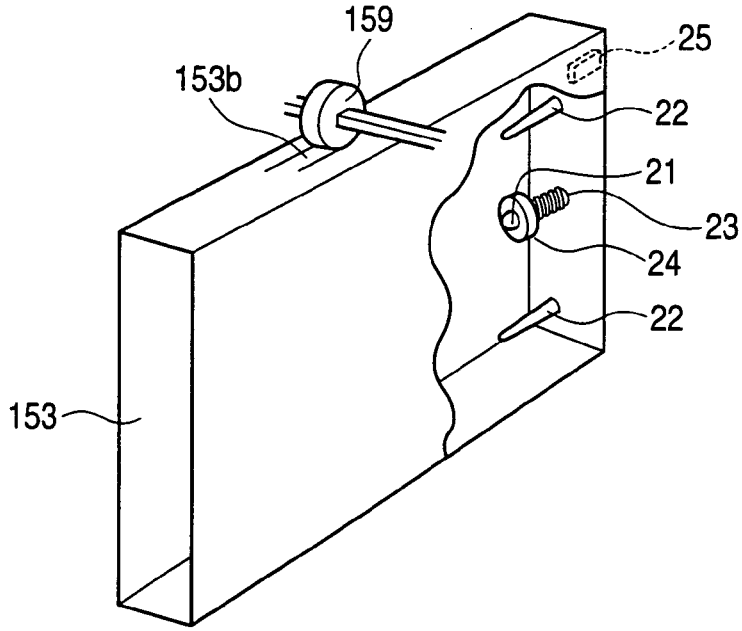
FIG. 14 is a perspective view to show the internal structure of a storage section of one color ink cartridge in a holder main unit of the ink cartridge holder in FIG. 12.

FIG. 14 is a perspective view to show the internal structure of the storage section 153 of one color ink cartridge 10 in the holder main unit 151. An ink supply needle 21 inserted into the ink supply port 13 of the ink cartridge 10 and positioning needles 22 inserted into the positioning holes 14 of the ink cartridge 10 are disposed on the inner rear face of the storage section 153 so as to project in the drawing-out, pushing direction of the ink cartridge 10.

Figure 15A:
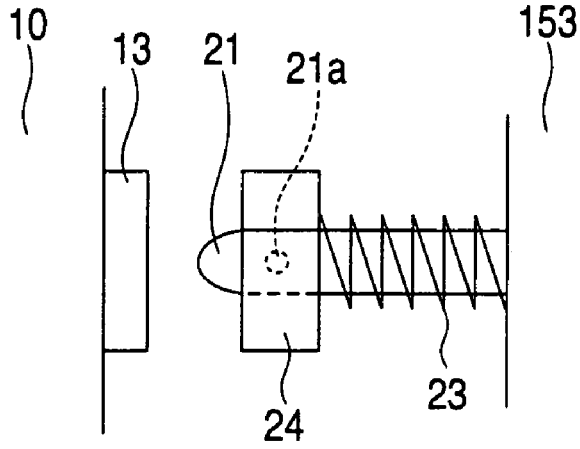
FIGS. 15A and 15B are plan views to show details of an ink supply needle of the storage section of the ink cartridge in FIG. 14.

FIG. 15A is a plan view to show details of the ink supply needle 21. The ink supply needle 21 is formed in a tip side with a supply port 21*a* and is connected at the rear end to the ink tube 124. A cylindrical rubber valve 24 urged axially by a compression spring 23 inserted in the rear end and blocking the supply port made in the tip side of the ink supply needle 21 is fitted into the ink supply needle 21, whereby the ink supply channel in the ink jet printer 100 can be maintained in the closed state.

Figure 15B:
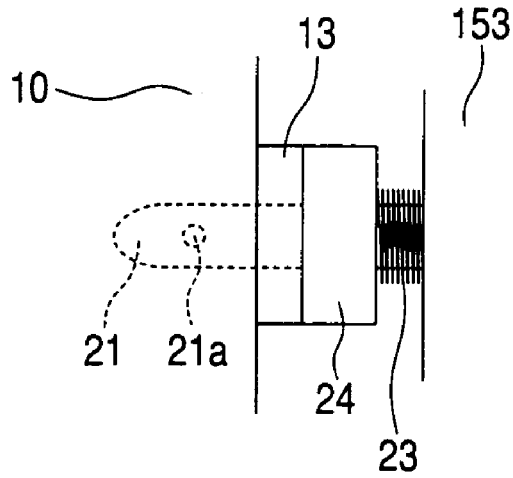

In the configuration, when the user pushes the ink cartridge 10 into the storage section 153 as shown in FIG. 15A, the ink supply needle 21 is inserted into the ink supply port 13 and the valve 24 is pushed by the rubber packing of the ink supply port 13 and is pushed into the rear end side of the ink supply needle 21, as shown in FIG. 15B. Accordingly, the supply port 21*a* covered with the valve 24 is exposed and thus ink in the ink tank of the ink cartridge 10 is supplied from the ink supply port 13 through the supply port 21*a* of the ink supply needle 21 to the ink tube 124.

On the other hand, when the user draws out the ink cartridge 10 from the storage section 153, the ink supply needle 21 is also drawn out from the ink supply port 13 and thus the valve 24 pushed by the rubber packing of the ink supply port 13 is pushed out to the tip side of the ink supply needle 21 by the restoring force of the compression spring 23. Accordingly, the exposed supply port 21*a* is again covered with the valve 24.

As shown in FIG. 14, a connector 25 electrically connected to the IC 16 of the ink cartridge 10 is put on an upper part of the inner rear face of the storage section 153. The connector 25 is connected to the FFC 123 and the control section of the ink jet printer 100 can read and write ink information from and into the IC 16 of the ink cartridge 10. Further, the storage section 153 is formed at the top center with a retention claw 153*b* brought into or out of engagement with the retention protrusion 17 of the ink cartridge 10 in association with a cam 159.

As shown in FIG. 12, the control lever 154 placed in the holder main unit 151 is disposed swingably up and down along a guide groove 151*a* made in a longitudinal direction in the holder main unit 151. The control lever 154 swings up and down, thereby electrically controlling write of ink information into the IC 16 disposed in the ink cartridge 10 and mechanically controlling drawing out/inserting of the ink cartridge 10 from/into the storage section 153.

That is, when the control lever 154 is positioned at the top, write of ink information into the IC 16 disposed in the ink cartridge 10 is inhibited and drawing out/inserting of the ink cartridge 10 from/into the storage section 153 is enabled. On the other hand, when the control lever 154 is positioned at the bottom, write of ink information into the IC 16 disposed in the ink cartridge 10 is enabled and drawing out/inserting of the ink cartridge 10 from/into the storage section 153 is disabled.

The control lever 154 having such a function is provided, thereby making it possible to use a large ink cartridge. That is, in related arts, write of ink information into an IC disposed in an ink cartridge is controlled by the opening/closing operation of a cover of an ink cartridge holder. However, when a large ink cartridge is set in a holder main unit, it projects to the front side and the cover cannot be closed and therefore write of ink information into the IC disposed in the ink cartridge cannot be controlled.

In contrast, write of ink information into the IC 16 disposed in the ink cartridge 10 of the embodiment is controlled by swinging the control lever 154 of the ink cartridge holder 150 as described above. Thus, when a large ink cartridge is set in the holder main unit 151, if it projects to the front side and the cover 152 cannot be closed, write of ink information into the IC disposed in the large ink cartridge can be controlled.

By the way, ink in each color ink cartridge 10 stored in the ink cartridge holder 150 is pressurized by the ink pressure supply means and is sent to the recording head unit 121, as described above. Thus, with ink supply means using the head difference as in the ink jet printer in the related arts, an ink cartridge holder needs to be disposed above a carriage, but the ink cartridge holder 150 can supply ink regardless of where it is disposed, so that the ink cartridge holder 150 can be set at any desired location.

Figure 16:
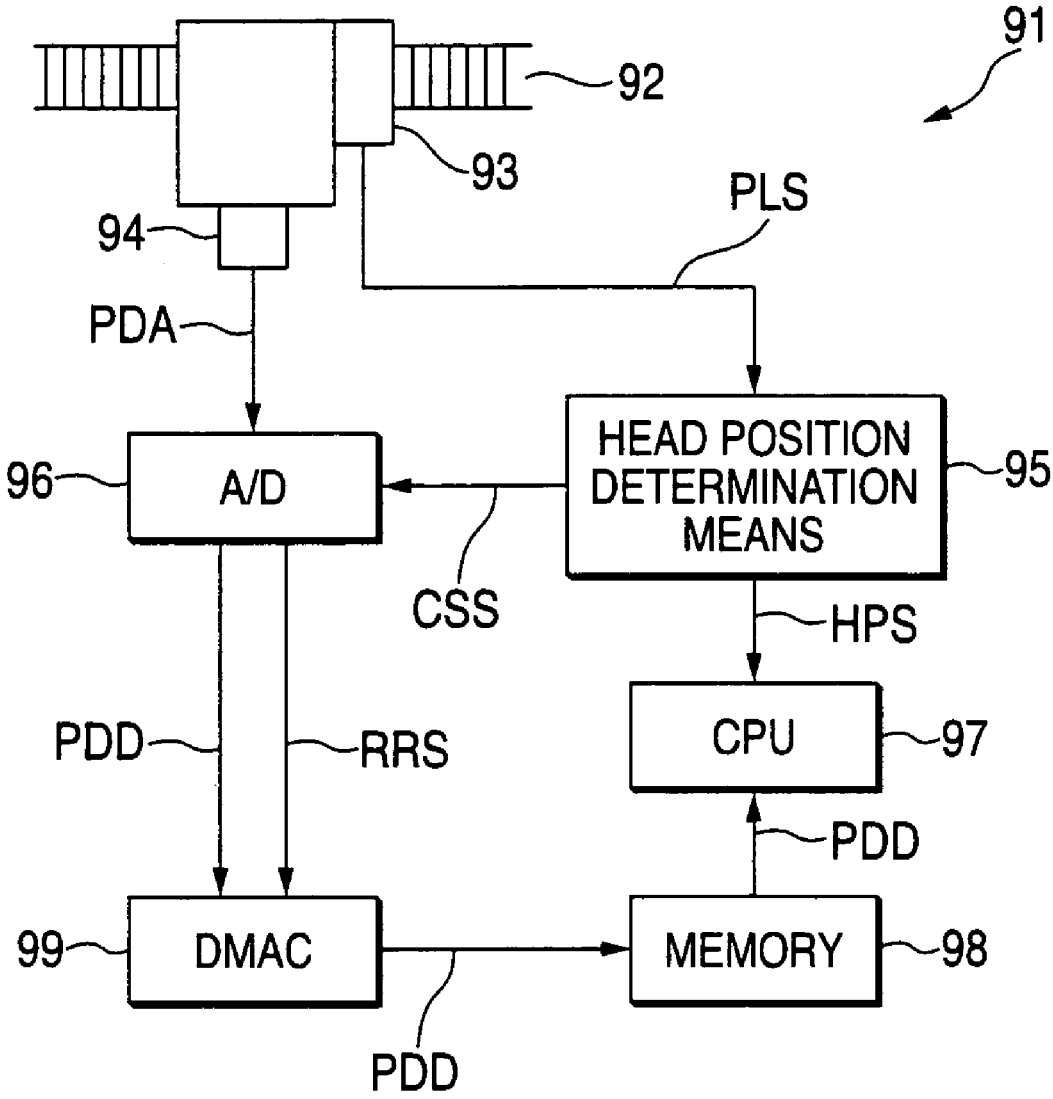
FIG. 16 is a block diagram to show an embodiment of a paper width detection apparatus of the invention.

FIG. 16 is a block diagram to show an embodiment of a paper width detection apparatus 91 of the invention. This paper width detection apparatus 91 includes an encoder 92, a photointerrupter 93, a paper detection sensor 94, head position determination means 95, an A/D converter 96, a CPU 97, memory 98, and a DMAC 99. The encoder 92 is disposed in the printer main unit and the photointerrupter 93 is disposed on the carriage 122 for generating a pulse signal PLS when the photointerrupter 93 crosses a slit of the encoder 92.

The paper detection sensor 94 applies light, for example, detects the reflected light amounts on the roll paper surface and the platen surface (reflected light amount on the roll paper surface>reflected light amount on the platen surface) and the contrast between the edge of the roll paper and the platen surface, and generates a detection signal PDA. The head position determination means 95 generates a conversion start command CSS of an analog detection signal PDA at the timing of the pulse signal PLS from the photointerrupter 93, determines the position of the recording head unit based on the pulse signal PLS, and generates a head position signal HPS. The head position determination means 95 is provided as a part of an ASIC.

The A/D converter 96 converts the analog detection signal PDA from the paper detection sensor 94 into a digital detection signal PDD and generates a transfer request signal RRS in response to the conversion start command CSS from the head position determination means 95. The DMAC 99 reads the detection signal PDD and writes the signal into the memory 98 in response to the transfer request signal RRS from the A/D converter 96. The CPU 97 computes the roll paper width based on the detection signal PDD stored in the memory 98.

Figure 17:
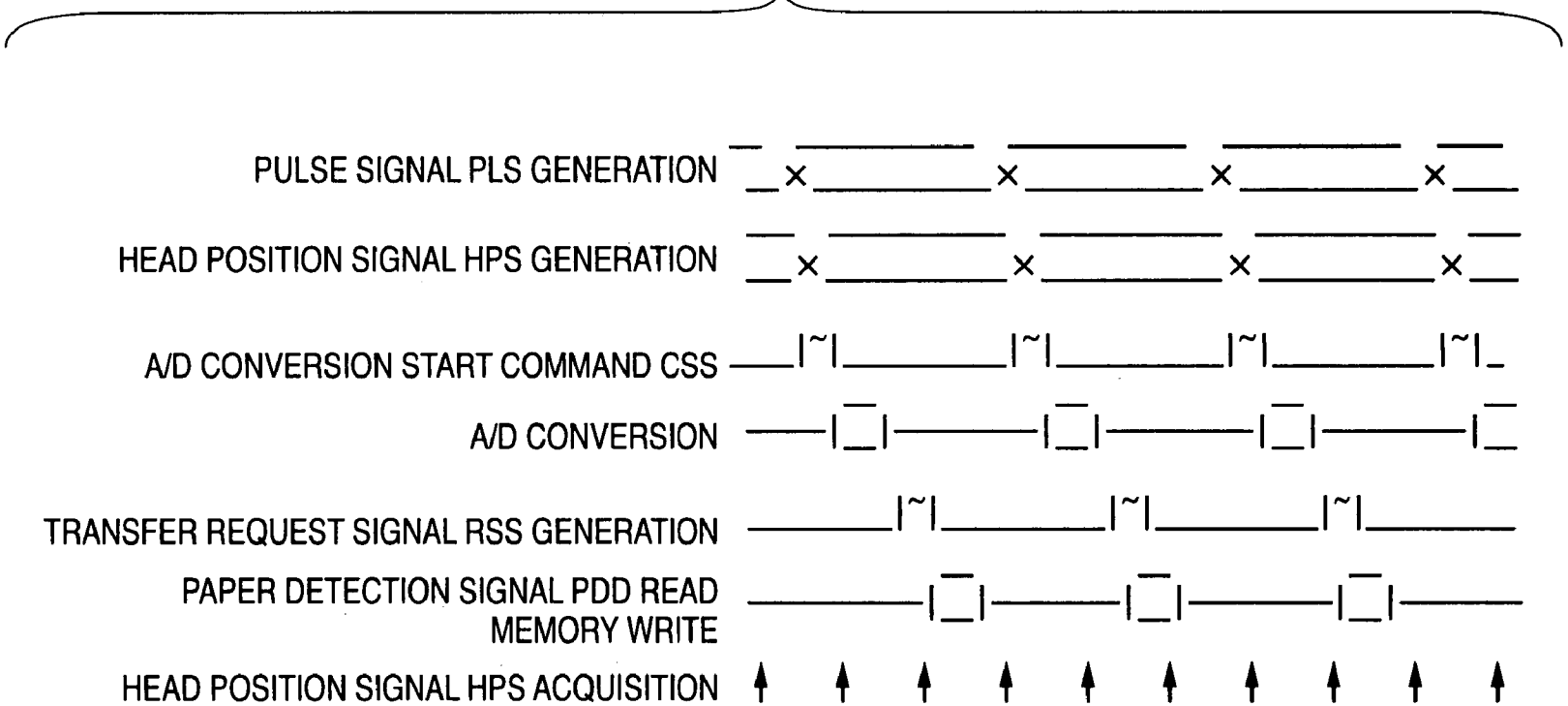
FIG. 17 is a time chart to show the paper width detection operation of the paper width detection apparatus in FIG. 16.
Figure 18:
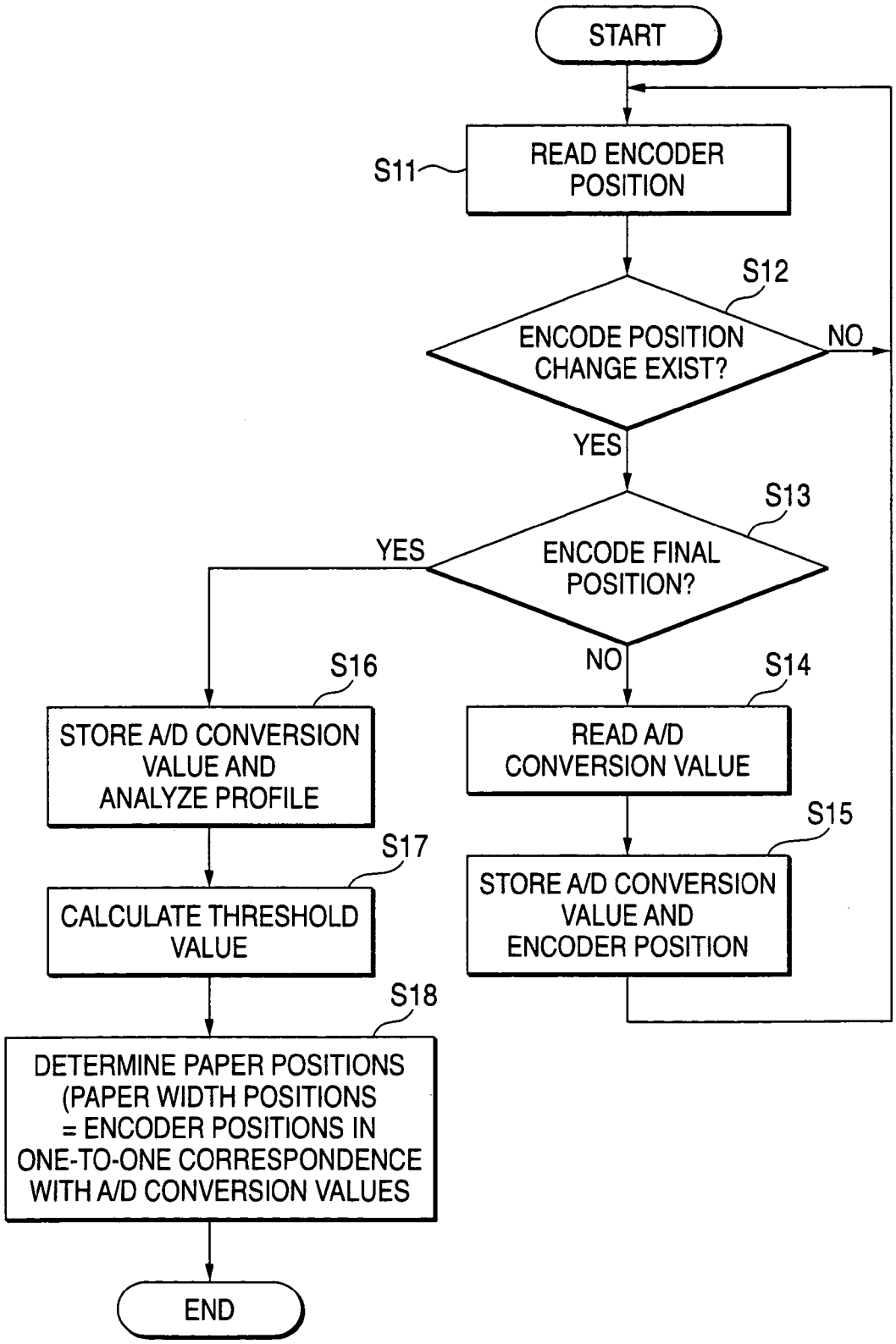
FIG. 18 is a flowchart to show the paper width detection operation of the paper width detection apparatus in FIG. 16.

The roll paper width detection operation in the configuration will be discussed with reference to the block diagram of FIG. 16, a time chart of FIG. 17, and a flowchart of FIG. 18. The head position determination means 95 generates a conversion start command CSS of an analog detection signal PDA and sends the command to the A/D converter 96 at the timing of a pulse signal PLS of a 1/180 inch period sent from the photointerrupter 93.

The A/D converter 96 starts processing of converting the analog detection signal PDA sent from the paper detection sensor 94 into a digital detection signal PDD with the conversion start command CSS of the analog detection signal PDA from the head position determination means 95 as a trigger. Upon completion of converting the analog signal into the digital detection signal PDD, the A/D converter 96 generates a transfer request signal RRS and sends the signal to the DMAC 99.

On the other hand, the head position determination means 95 determines the position of the recording head unit based on the pulse signal PLS and generates a head position signal HPS. The CPU 97 reads the head position signal HPS from the head position determination means 95 in a shorter period than the pulse interval (step S11). When determining that the head position signal HPS changes (step S12), the CPU 97 determines whether or not the recording head unit reaches the final position of the encoder 92 (step S13).

When the CPU 97 determines that the recording head unit does not yet reach the final position of the encoder 92, the DMAC 99 reads the detection signal PDD from the A/D converter 96 and writes the signal into the memory 98 with the transfer request signal RRS from the A/D converter 96 as a trigger (steps S14 and S15). Since the DMAC 99 is a unit specialized for data transfer, it can execute the processing at higher speed than the CPU 97 which must perform a plurality of processes in a time-division manner. At this time, the CPU 97 may write the head position signal HPS corresponding to the detection signal PDD written into the memory 98 into the memory 98.

On the other hand, when the CPU determines at step S13 that the recording head unit reaches the final position of the encoder 92, the CPU 97 reads the detection signal PDD from the memory 98, analyzes a profile of the detection signal PDD, and calculates a threshold value (steps S16 and S17). The calculation method of the threshold value is a method of analyzing the roll paper surface detection signal PDD and the platen surface detection signal PDD and calculating a half value of the difference between the signals to find a threshold value. The calculation method of the threshold value can be applied to all types of paper.

The paper width detection apparatus 1 in the related art sends the pulse signal PLS from the photointerrupter 3 and executes A/D conversion of the detection signals PDA and PDD by the A/D converter 6 under asynchronous control. Therefore, the head position signal HPS and the detection signal PDD need to be stored in relation to each other. However, the paper width detection apparatus 91 of the embodiment uses sending the pulse signal PLS from the photointerrupter 93 as a trigger of A/D conversion of the detection signal PDA, PDD by the A/D converter 96 under synchronous control. Thus, when the detection signals PDD are stored in the memory 98 in order over the full width of roll paper, the detection signals PDD stored at adjacent addresses become data at the interval of one pulse signal PLS and thus the need for storing the head position signal HPS and the detection signal PDD in relation to each other is eliminated.

Therefore, the CPU 97 reads the addresses of the detection signals PDD when exceeding the calculated threshold value and when falling below the threshold value from the memory 98 and computes the roll paper width based on the addresses (step S18) If the head position signals HPS are stored in the memory 98, the CPU 97 may read the head position signals HPS corresponding to the detection signals PDD when exceeding the calculated threshold value and when falling below the threshold value and may compute the roll paper width.

Figure 19:
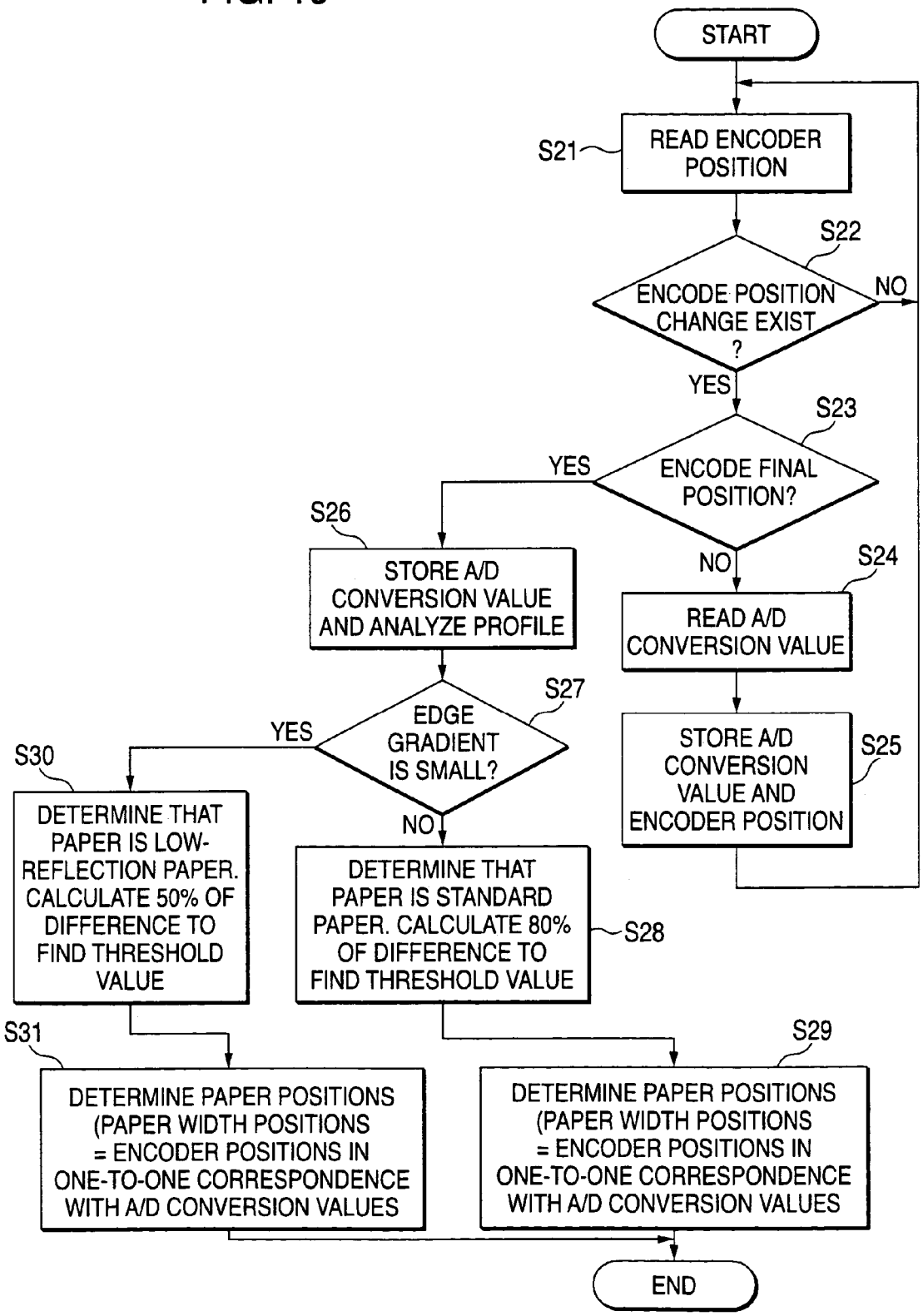
FIG. 19 is a flowchart to show different paper width detection operation of the paper width detection apparatus in FIG. 16.

FIG. 19 is a flowchart to show different roll paper width detection operation. The method in the example shown in FIG. 18 can be applied regardless of the paper type; a method in an example shown in FIG. 19 can be applied separately to standard reflection paper (ordinary paper) and low-reflection paper. The head position determination means 95 generates a conversion start command CSS of an analog detection signal PDA and sends the command to the A/D converter 96 at the timing of a pulse signal PLS of a 1/180 inch period sent from the photointerrupter 93.

The A/D converter 96 starts processing of converting the analog detection signal PDA sent from the paper detection sensor 94 into a digital detection signal PDD with the conversion start command CSS of the analog detection signal PDA from the head position determination means 95 as a trigger. Upon completion of converting the analog signal into the digital detection signal PDD, the A/D converter 96 generates a transfer request signal RRS and sends the signal to the DMAC 99.

On the other hand, the head position determination means 95 determines the position of the recording head unit based on the pulse signal PLS and generates a head position signal HPS. The CPU 97 reads the head position signal HPS from the head position determination means 95 in a shorter period than the pulse interval (step S21). When determining that the head position signal HPS changes (step S22), the CPU 97 determines whether or not the recording head unit reaches the final position of the encoder 92 (step S23).

When the CPU 97 determines that the recording head unit does not yet reach the final position of the encoder 92, the DMAC 99 reads the detection signal PDD from the A/D converter 96 and writes the signal into the memory 98 with the transfer request signal RRS from the A/D converter 96 as a trigger (steps S24 and S25). Since the DMAC 99 is a unit specialized for data transfer, it can execute the processing at higher speed than the CPU 97 which must perform a plurality of processes in a time-division manner. At this time, the CPU 97 may write the head position signal HPS corresponding to the detection signal PDD written into the memory 98 into the memory 98. On the other hand, when the CPU determines at step S23 that the recording head unit reaches the final position of the encoder 92, the CPU 97 reads the detection signal PDD from the memory 98 and analyzes a profile of the detection signal. PDD (step S26).

Figure 20:
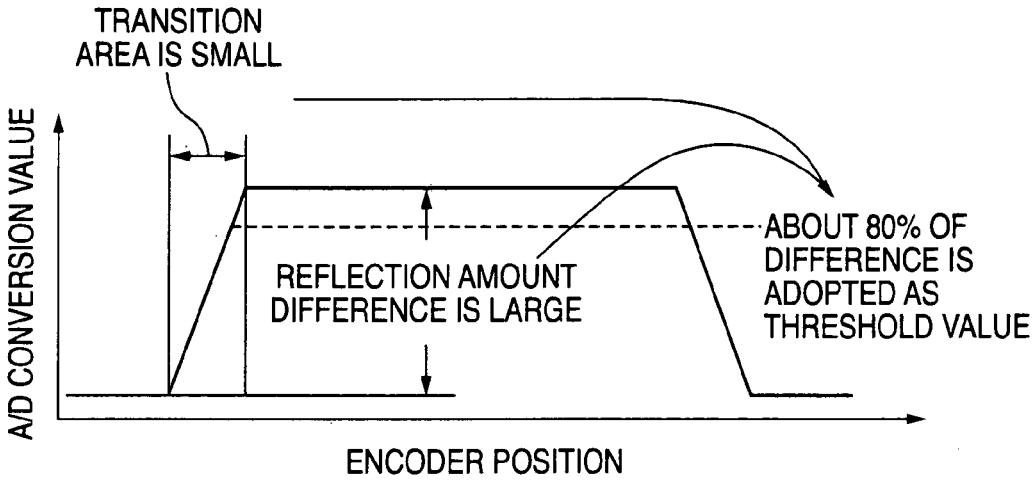
FIG. 20 is a drawing to show an example of the profile of a detection signal of standard paper.
Figure 21:
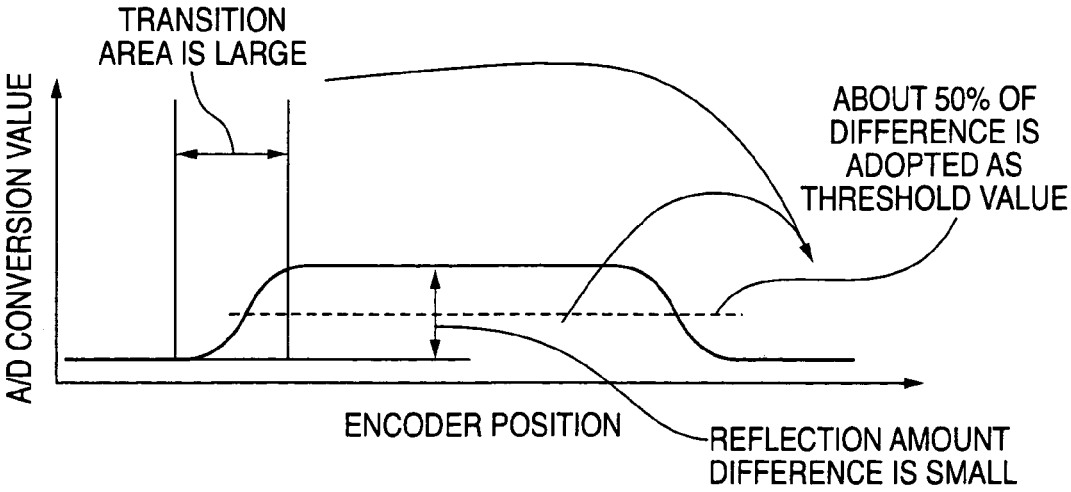
FIG. 21 is a drawing to show an example of the profile of a detection signal of low-reflection paper.

FIG. 20 is a drawing to show an example of the profile of the detection signal PDD of standard paper. FIG. 21 is a drawing to show an example of the profile of the detection signal PDD of low-reflection paper. Since the value of the detection signal PDD of standard paper is larger than the value of the detection signal PDD of low-reflection paper, change in the detection signal PDD of standard paper in the transition area between the roll paper end and the platen surface becomes steep as compared with change in the detection signal PDD of low-reflection paper. Then, the CPU 97 determines the change rate of the detection signal PDD in the transition area, namely, gradient (step S27). If the gradient is larger than a preset gradient, the CPU 97 determines that the paper is standard paper; if the gradient is smaller than the preset gradient, the CPU 97 determines that the paper is low-reflection paper.

When determining that the paper is standard paper, the CPU 97 calculates a value of 80% of the difference between the roll paper surface detection signal PDD and the platen surface detection signal PDD to find a threshold value (step S28). The CPU 97 reads the addresses of the detection signals PDD when exceeding the calculated threshold value and when falling below the threshold value from the memory 98 and computes the roll paper width based on the addresses (step S29).

On the other hand, when determining that the paper is low-reflection paper, the CPU 97 calculates a value of 50% of the difference between the roll paper surface detection signal PDD and the platen surface detection signal PDD to find a threshold value (step S30). The CPU 97 reads the addresses of the detection signals PDD when exceeding the calculated threshold value and when falling below the threshold value from the memory 98 and computes the roll paper width based on the addresses (step S31). If the head position signals HPS are stored in the memory 98, the CPU 97 may read the head position signals HPS corresponding to the detection signals PDD when exceeding the calculated threshold value and when falling below the threshold value and may compute the roll paper width.

Figure 22:
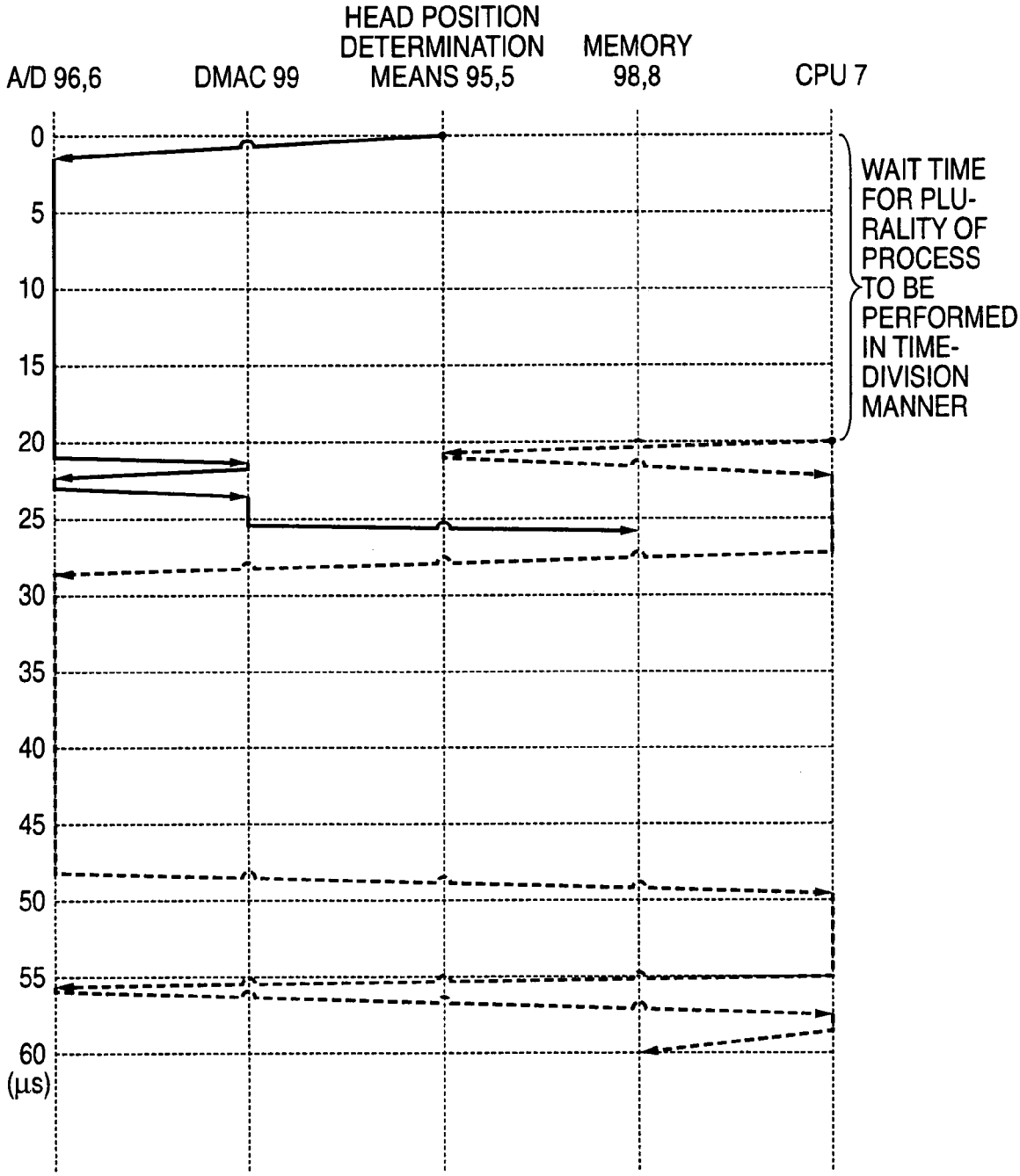
FIG. 22 is a drawing of making comparison between the processing time from operation start of head position determination means for an A/D converter and write termination into memory in the paper width detection apparatus in FIG. 16 and that in the paper width detection apparatus in related art.
Figure 23:
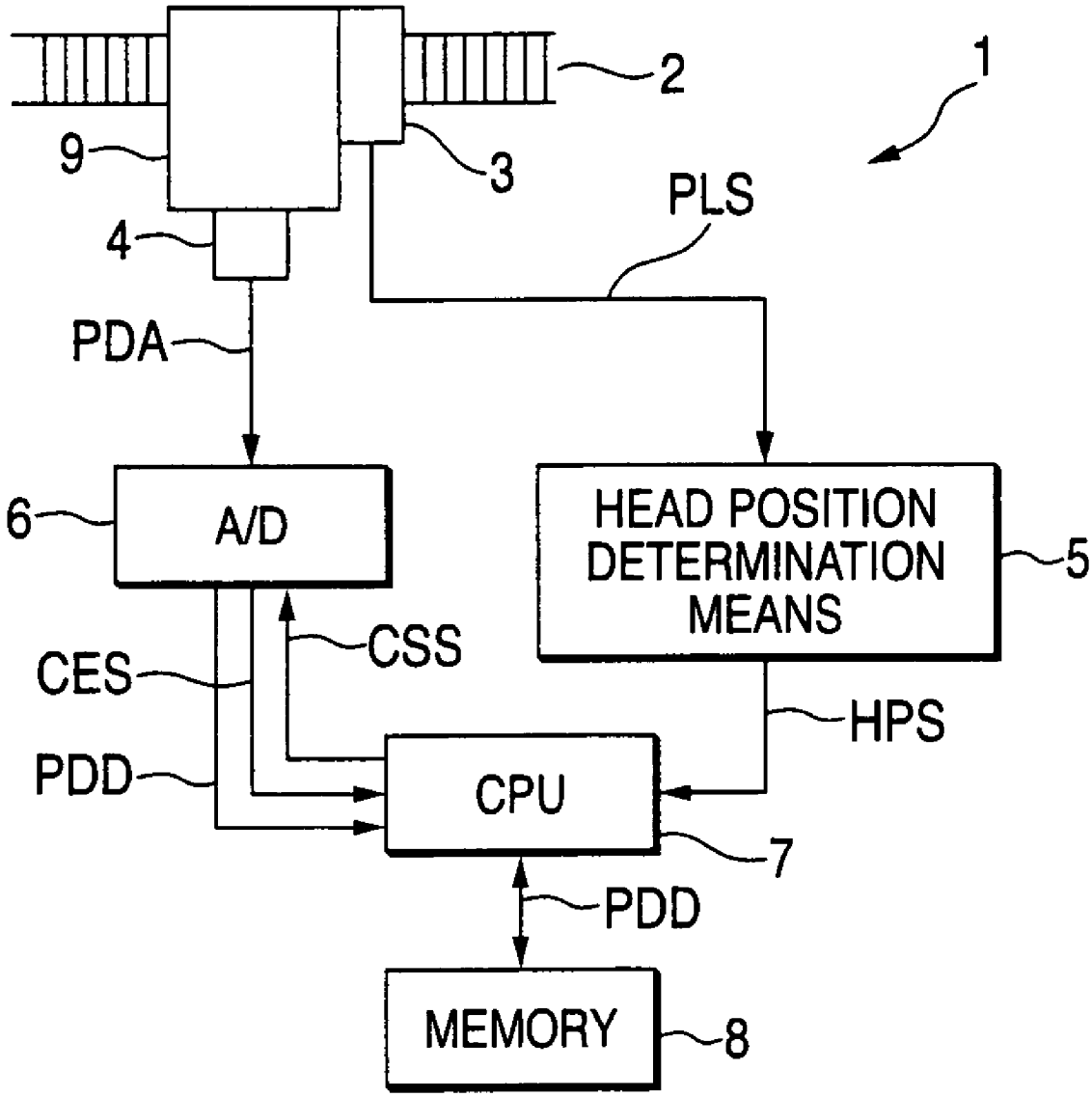
FIG. 23 is a block diagram to show a paper width detection apparatus in related art.
Figure 24:
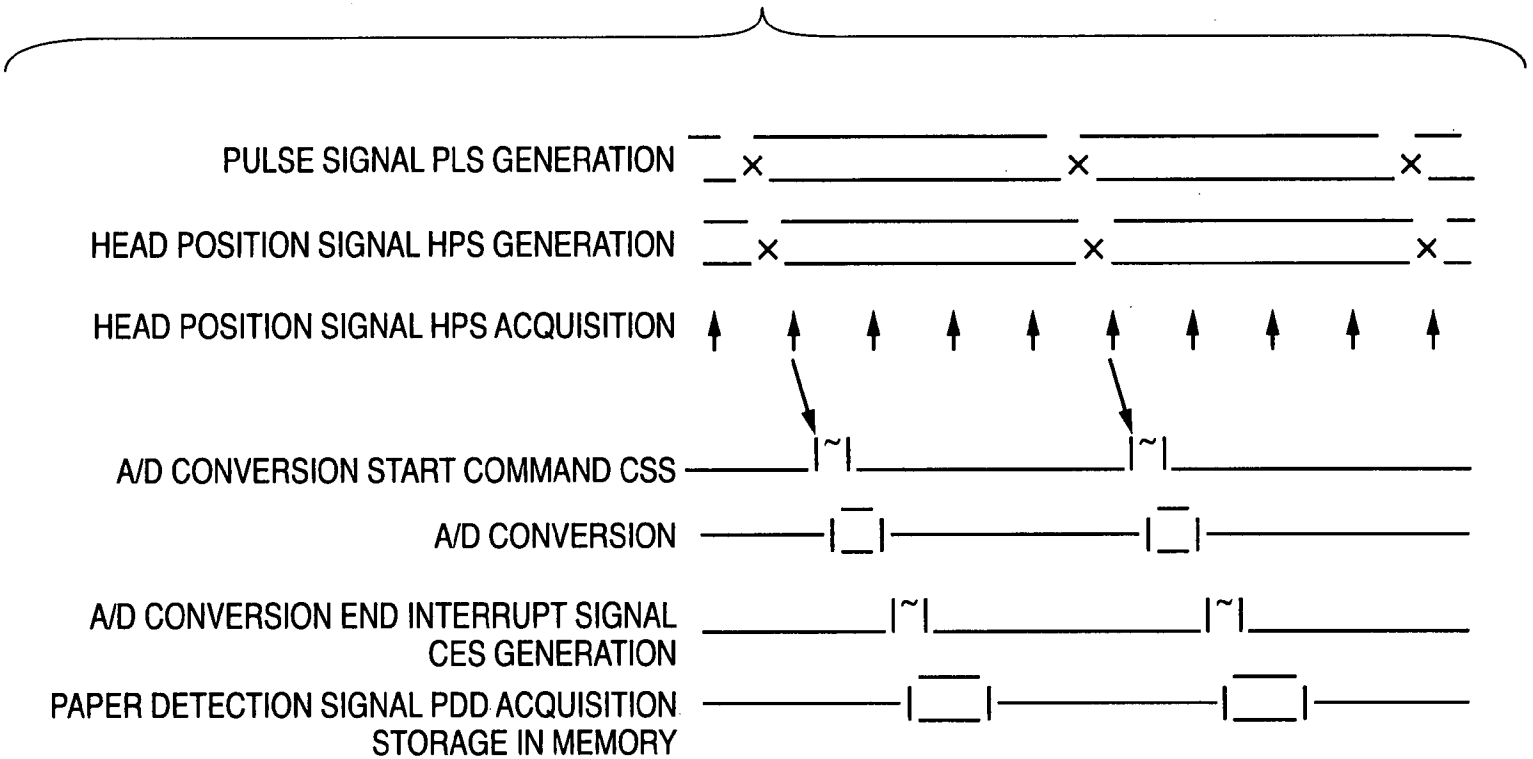
FIG. 24 is a time chart to show the paper width detection operation of the paper width detection apparatus in FIG. 23.
Figure 25:
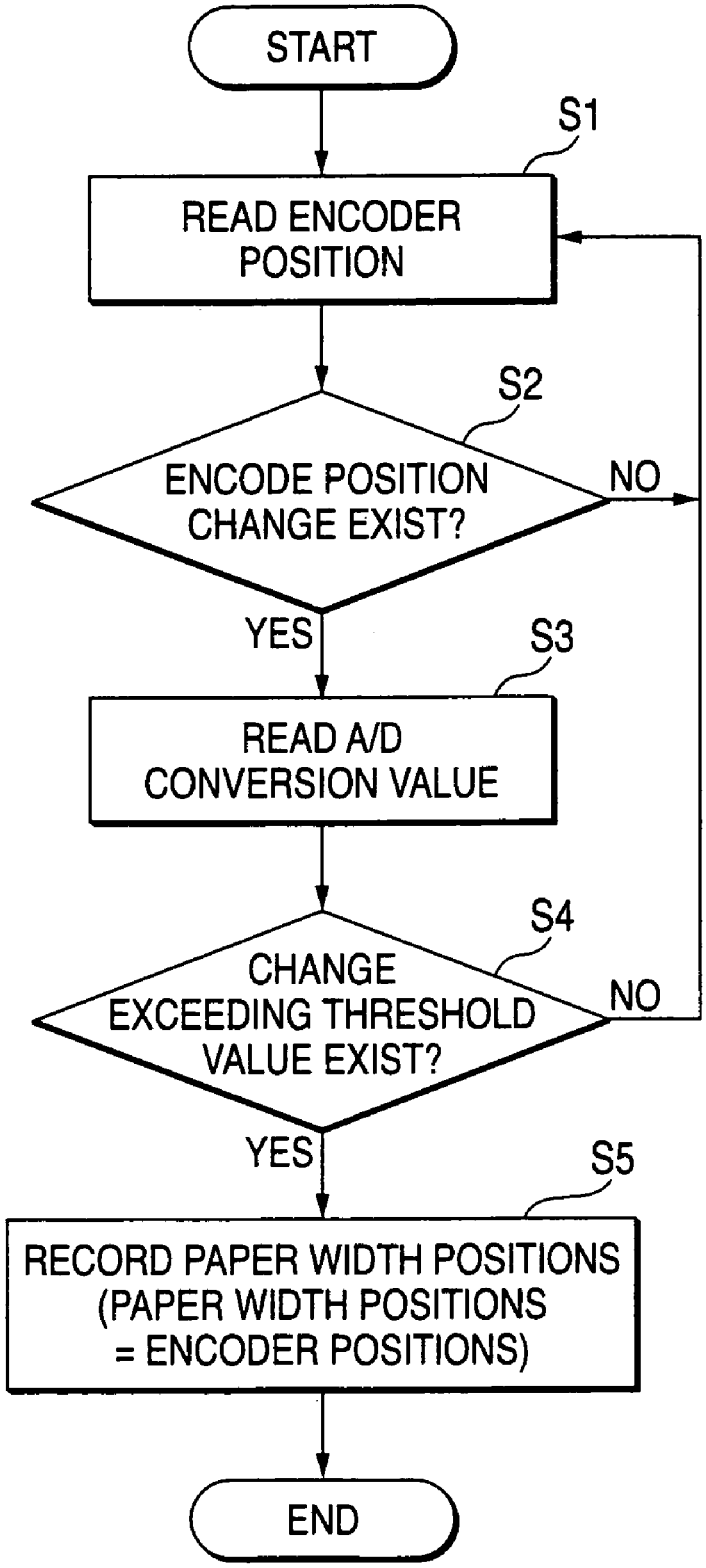
FIG. 25 is a flowchart to show the paper width detection operation of the paper width detection apparatus in FIG. 23.

FIG. 22 is a drawing of making comparison between the processing time from operation start of the head position determination means 95 for the A/D converter 96 and write termination into the memory 98 in the paper width detection apparatus 91 of the embodiment and the processing time from operation start of the head position determination means 5 for the A/D converter 6 and write termination into the memory 8 in the paper width detection apparatus 1 in the related art. As obvious from the drawing, the processing time of the paper width detection apparatus 1 in the related art indicated by the dotted line is about 60 μs, but the processing time of the paper width detection apparatus 91 of the embodiment is about 30 μs and the processing time can be shortened about 30 μs.

Thus, the DMAC 99 rather than the CPU 97 performs read of the digital paper detection signal PDD from the A/D converter 96 and write of the paper detection signal PDD into the memory 98 particularly requiring the processing time and the CPU 97 only performs acquisition of the head position signals HPS from the head position determination means 95 and determination of the paper width detection end position, so that the processing capability of the CPU 97 is not wasted.

Most of recent comparatively inexpensive one-chip microcomputers may contain DMAC 99 and A/D converter 96 that can generate a transfer request signal sent to the DMAC 99. If such a one-chip microcomputer is used, high-speed paper width detection can be executed without increasing the cost, and expensive CPU 97 having a comparatively high processing capability need not be used, of course. If the carriage 122 is moved at high speed, for example, at speed almost equal to the speed at the recording time, the roll paper width can be detected.

Although the invention has been described in the specific embodiments, it is to be understood that the invention is not limited to the specific embodiments and is applied to other embodiments in the scope of the invention defined in the claims, of course. For example, in the embodiments, the record apparatus has been described by taking the ink jet printer as an example, but the invention is not limited to it. The invention can also be applied to any record apparatus such as a facsimile machine or a copier, for example, if the record apparatus includes a paper width detection apparatus in a record section.

What is claimed is:

1. A width detection method of a record medium for detecting a width of the record medium on which information is recorded by a recording head, said width detection method comprising the steps of:

storing values of detection signals of the record medium and a placement face thereof detected as the recording head moves from one end of the record medium to an opposite end;

finding a predetermined threshold value based on a profile found from the values of the detection signals; and determining both ends of the record medium according to the threshold value and finding the width of the record medium;

wherein the threshold value and the width are both determined from the same stored values obtained during a single said movement of the recording head from the one of the record medium to the opposite end.

2. The width detection method as claimed in claim 1 wherein the threshold value is found based on a profile of the values of all detection signals stored at pulse interval input as the recording head moves from the one end of the record medium to the opposite end.

3. The width detection method as claimed in claim 1 or 2 wherein the threshold value is calculated based on a difference between the value of the detection signal of the record medium and the value of the detection signal of the placement face of the record medium.

4. A width detection apparatus of a record medium for detecting a width of the record medium on which information is recorded by a recording head, said width detection apparatus comprising:

medium detection means for sending detection signals of the record medium and a placement face thereof detected as the recording head moves from one end of the record medium to an opposite end;

transfer means for writing the detection signals from said medium detection means into storage means;

computation processing means for finding a predetermined threshold value based on a profile found from the values of the detection signals stored in the storage means, determining both ends of the record medium according to the threshold value, and finding the width of the record medium;

wherein the threshold value and the width are both determined from the same values stored in the storage means, the values stored in the storage means being obtained during a single said movement of the recording head from the one end of the medium to the opposite end.

5. The width detection apparatus as claimed in claim 4 further comprising head detection means for sending a pulse signal as the recording head moves, wherein said medium detection means sends the detection signals of the record medium and the placement face thereof at the pulse interval of the pulse signal from the head detection means and said computation processing means finds the predetermined threshold value based on a profile of the values of all the detection signals stored in the storage means.

6. The width detection apparatus as claimed in claim 4 or 5 wherein said computation processing means finds the threshold value based on a difference between the value of the detection signal of the record medium and the value of the detection signal of the placement face of the record medium.

7. The width detection apparatus as claimed in claim 4 or 5, wherein said transfer means is a DMAC.

8. The width detection apparatus as claimed in claim 4 or 5, wherein said computation processing means is a CPU.

9. A record apparatus for recording information on a record medium by scanning a recording head, said record apparatus comprising a width detection apparatus of a record medium as claimed in claim 4 or 5.

10. The width detection apparatus according to claim 4, wherein:

the media detection means includes:

a detection sensor sensing the record medium and a placement face, and generating the detection signals, head position determination means for detecting a position of the head, and generating a head position signal, and an A/D converter converting the detection signals generated by the detection sensor into digital signals in synchronization with the head position signal; and the transfer means transfers the digital signals to the storage means.

11. The width detection apparatus according to claim 10, wherein the head position determination means detects the position at even intervals, regarding to distance, to generate the head position signal.

12. The width detection apparatus according to claim 11, wherein the head position signal is a pulse signal.

* * * * *